US011352796B2

(12) United States Patent
Vanthournout

(10) Patent No.: US 11,352,796 B2
(45) Date of Patent: Jun. 7, 2022

(54) SHADING SYSTEM FOR COVERING AN UNDERLYING SPACE

(71) Applicant: HELIOS TRADING NV, Aalter (BE)

(72) Inventor: Gwenn Vanthournout, Kuurne (BE)

(73) Assignee: HELIOS TRADING NV, Aalter (BE)

( * ) Notice: Subject to any disclaimer, the term of this patent is extended or adjusted under 35 U.S.C. 154(b) by 0 days.

(21) Appl. No.: 17/254,825

(22) PCT Filed: Jul. 3, 2019

(86) PCT No.: PCT/EP2019/067838
§ 371 (c)(1),
(2) Date: Dec. 21, 2020

(87) PCT Pub. No.: WO2020/007908
PCT Pub. Date: Jan. 9, 2020

(65) Prior Publication Data

US 2021/0262237 A1 Aug. 26, 2021

(30) Foreign Application Priority Data

Jul. 6, 2018 (EP) ..... 18182132

(51) Int. Cl.
*E04F 10/10* (2006.01)

(52) U.S. Cl.
CPC ..... *E04F 10/10* (2013.01)

(58) Field of Classification Search
CPC ..... E04F 10/10; E04F 10/08; E04H 15/58; E04D 13/00; E04B 7/16; E04B 7/163; E06B 7/084; E06B 7/086
USPC ..... 160/61
See application file for complete search history.

(56) References Cited

U.S. PATENT DOCUMENTS 8,756,873 B1 6/2014 Hire
9,422,715 B1 * 8/2016 Selzer ..... E04D 11/00
10,815,689 B2 * 10/2020 Ji ..... E04F 10/10
(Continued)

FOREIGN PATENT DOCUMENTS

EP 3015618 A1 5/2016
FR 2701977 A1 9/1994
(Continued)

OTHER PUBLICATIONS

Search Report and Written Opinion from corresponding European Application No. EP18182132, dated Jan. 4, 2019.
(Continued)

*Primary Examiner* — Beth A Stephan
(74) *Attorney, Agent, or Firm* — Workman Nydegger

(57) ABSTRACT

A shading system includes a housing extending along a longitudinal housing direction; a plurality of shading blades extending along a longitudinal blade direction; a coupling system comprising: a first rail; and a second rail. Each of the shading blades is rotatably coupled to the first rail and to the second rail. A coupling element is rotatably coupled to the housing and rotatably coupled to the second rail. An actuator to translate the first rail along the longitudinal housing direction. The coupling element rotates the shading blades by limiting a translation of the second rail. A rain gutter extends along the longitudinal housing direction below the plurality of shading blades.

11 Claims, 10 Drawing Sheets

(56) References Cited

U.S. PATENT DOCUMENTS

| | | | | |
|---|---|---|---|---|
| 10,988,926 | B2 * | 4/2021 | Mitchell | E04B 7/163 |
| 11,149,438 | B2 * | 10/2021 | Torman | E04F 10/10 |

FOREIGN PATENT DOCUMENTS

| | | | |
|---|---|---|---|
| JP | S5998097 | U | 7/1984 |
| JP | H05231076 | A | 9/1993 |

OTHER PUBLICATIONS

International Search Report and Written Opinion from PCT Application No. PCT/EP2019/067838, dated Oct. 1, 2019.

* cited by examiner

SHADING SYSTEM FOR COVERING AN UNDERLYING SPACE

FIELD OF THE INVENTION

The present invention generally relates to a shading system for covering an underlying space. More particularly, the present invention generally relates to a shading system for protecting an underlying space from weathering agents and in particular from sun and rain.

BACKGROUND OF THE INVENTION

Several solutions for shading devices for outdoor areas are known, which comprise a support structure, such as for example a canopy, fixed to the ground and provided with a longitudinal frame which supports a plurality of shading blades. The shading blades are mounted on the frame such that the shading blades can rotate with respect to the frame between an open position and a closed position in which the shading blades protect an underlying space. Examples of such shading devices are for example described in JPS5998097U3, JPH05231076A, FR2701977A1 and U.S. Pat. No. 8,756,873B1.

An example of such a covering apparatus is described in EP3015618A1. The covering apparatus of EP3015618A1 is used for obtaining pergolas, verandas and structures for covering outdoor settings, such as for example gardens of private homes or open spaces of public spaces. The covering apparatus of EP3015618A1 comprises a support structure provided with two lateral beams that are parallel to each other and side-by-side. A plurality of covering blades are arranged on the frame one after the other along the direction of the lateral beams and such that each covering blade extends along a direction substantially orthogonal to the direction of the lateral beams. The covering blades can rotate with respect to the frame between an open position and a closed position in which the covering blades cover an underlying space. The covering apparatus further comprises movement means mechanically connected to the covering blades and drivable by actuator means to slide along at least one of the lateral beams between a retreated position and an advanced position in order to move the covering blades respectively between the closed position and the open position. The covering apparatus further comprises a plurality of orientation guides fixed along at least one of the lateral beams at the ends of the plurality of covering blades. Each covering blade of the covering apparatus of EP3015618A1 comprises a first coupling element constrained to the movement means, and each covering blade of the covering apparatus of EP3015618A1 further comprises a second coupling element constrained to the corresponding orientation guide. Each covering blade, in its movement between the closed position and the open position, completes a rotation-translation movement, when the actuator means act on the movement means in order to drive the latter to move the first coupling element of each covering blade to slide along a sliding direction, pushing the respective second coupling element to slide in the respective orientation guide.

In the covering apparatus of EP3015618A1, each covering blade is coupled to a first coupling element and a second coupling element. In other words, for each covering blade of the covering apparatus of EP3015618A1, a first coupling element and a second coupling element must be manufactured and must be mounted on the covering apparatus. Each covering blade of the covering apparatus of EP3015618A1 must be individually coupled to a first coupling element, then individually coupled to a second coupling element and then individually mounted on the frame of the covering apparatus. The manufacturing and the mounting of the covering apparatus of EP3015618A1 are therefore complex and time-consuming. Additionally, at least one of the lateral beams comprises a plurality of orientation guides which ensure that the covering blades of EP3015618A1 are individually rotated-translated. To each covering blade corresponds an orientation guide formed in the frame and in which one of the coupling element slides to trigger a rotation-translation of the corresponding covering blade. Each orientation guide only defines a path that one end of the corresponding covering blade must slide is in order to rotate between the closed and the open positions. The rotation-translation movement of a covering blade is therefore independent from the rotation-translation movement of another covering blade. Additionally, each covering blade is actuated by the movement means only on one of its ends along the direction of the lateral beams. The path of the orientation guide in which the other end of each covering blades slides must be made large enough to allow a complete rotation of each covering blade around the fixed rotation point formed by the only actuating point. The resulting design of the covering apparatus is therefore complex and space-consuming. Additionally, when one or more of the first and/or second coupling elements of the covering blades are defective, for example in the event that one of more of the first coupling elements are not sliding as expected when actuated by the movement means and/or in the event that one or more of the second coupling elements are not sliding as expected in the orientation guides, the corresponding defective covering blades risk damaging the adjacent covering blades which in the meantime are completing a rotation-translation movement under the same actuation by the movement means. For example, if one of the covering blades of the covering apparatus of EP3015618A1 remains in an open position due to a defect while the movement means further actuate the covering blades to slide in their closed positions, there is a risk that the covering blade preceding the defect covering blade along the direction of the lateral beams hits the defect covering blade when rotating/translating, and even presses against the defect covering blade, thereby risking damaging the defect covering blade, which would then requiring replacing to guarantee the water tightness of the covering apparatus of EP3015618A1.

In EP3015618A1, each lateral cap of each covering blade of the covering apparatus of EP3015618A1 comprises a drip catcher tab which allows conveying the rainwater which falls on the external wall of the corresponding covering blade into the underlying gutter, without parts of the water drops being able to re-ascend along the internal wall of the covering blade towards the centre of the latter and fall outside the lateral gutter on the underlying surface covered by the covering apparatus of EP3015618A1.

As visible on FIG. 18 of EP3015618A1, without the drip catcher tabs, there is a risk that droplets of rainwater splash in the gutter and fall outside the train gutter on the underlying space covered by the covering apparatus. This is due to the geometry and the mounting distance between the covering blades and the gutter. This risk is minimized in EP3015618A1 via the manufacturing and the mounting of individual drip catcher tabs which are individually mounted on each covering blade of the covering apparatus. The necessary systematic addition of the plurality of drip catcher tabs increases the complexity and the time needed to manufacture and mount each covering blade on the covering apparatus of EP3015618A1.

It is an objective of the present invention to disclose a device that overcomes the above identified shortcomings of existing solutions. More particularly, it is an objective to disclose a shading system which design is simple and reliable, while relying on simple manufacturing and mounting processes. It is a further objective to disclose a shading system which minimizes in a simple manner the risk that rainwater re-ascends from the gutter to the covering blades, thereby ensuring the space underlying the shading device stays dry.

SUMMARY OF THE INVENTION

According to a first aspect of the present invention, the above defined objectives are realized by a shading system for covering an underlying space, the shading system comprising:

- a housing extending along a longitudinal housing direction;
- a plurality of shading blades arranged one after the other along the longitudinal housing direction, each of the shading blades extending along a longitudinal blade direction traverse to the longitudinal housing direction; the shading blades being movable between a closed position thereby covering the underlying space, and at least one open position;
- a coupling system arranged between the housing and the plurality of shading blades, wherein the coupling system comprises:
  - a first rail comprising a first longitudinal axis along the longitudinal housing direction configured to translate along the longitudinal housing direction;
  - a second rail comprising a second longitudinal axis along the longitudinal housing direction;
  - wherein each of the shading blades is rotatably coupled to the first rail at a first coupling point and rotatably coupled to the second rail at a second coupling point; and
  - a coupling element rotatably coupled to the housing and rotatably coupled to the second rail;
- an actuator configured to translate the first rail along the longitudinal housing direction; whereby the coupling element limits a translation of the second rail along the longitudinal housing direction, thereby rotating the shading blades between the closed position and the at least one open position; and
- a rain gutter extending along the longitudinal housing direction and arranged below the plurality of shading blades.

This way, all the shading blades of the shading system according to the present invention simultaneously rotate between a closed position and at least one open position or between at least one open position and a closed position. Indeed, all the shading blades are rotatably coupled to the same first rail and are also all rotatably coupled to the same second rail such that the rotation of all the shading blades is coordinated and simultaneous. In other words, there is no need with the shading system according to the present invention to foresee the manufacturing and/or the mounting of individual coupling elements between each of the shading blades and the housing of the shading system. The design of the shading system according to the present invention is therefore simple. Additionally, the design of the shading system according to the present invention is compact. Indeed, each shading blade comprises two coupling points on each end of the shading blade along a direction traverse to the longitudinal blade direction: a first coupling point to the first rail and a second coupling point to the second rail. Both coupling points of each shading blade form a rotation point for the corresponding shading blade. In other words, with the shading system according to the present invention, there is no need to foresee orientation guides in the housing of the shading system to ensure a complete rotation of the shading blades. Indeed, when the actuator translates the first rail along the longitudinal housing direction, the simultaneous rotation of all the shading blades is achieved when the coupling element of the shading system holds a translation of the second rail along the longitudinal direction back, in other words limits a translation of the second rail along the longitudinal housing direction. The second rail does not rotate with respect to the first rail. In other words, the first rail and the second rail remain parallel to each other even when the shading blades rotate with respect to the longitudinal housing direction. When limiting the translation of the second rail along the longitudinal housing direction, the coupling element rotates with respect to the longitudinal housing direction.

Alternatively, the shading system according to the present invention comprises more than one actuator configured to translate the first rail along the longitudinal housing direction, for example two, three, four, five, etc. actuators. Alternatively, the shading system according to the present invention comprises more than one coupling element to limit the translation of the second rail along the longitudinal housing direction when the actuator translates the first rail along the longitudinal housing direction, for example two, three, four, five, etc. coupling elements. Alternatively, the first rail of the shading system according to the present invention comprises more than one rail and/or the second rail of the shading system according to the present invention comprises more than one rail. For example, the first rail comprises two, three, four, five, etc. . . . rails arranged one after the other along the longitudinal housing direction and which extend along the longitudinal housing direction and which can translate along the longitudinal housing direction. For example, the second rail comprises two, three, four, five, etc. . . . rails arranged one after the other along the longitudinal housing direction and which extend along the longitudinal housing direction and which can translate along the longitudinal housing direction. The shading blades are movable between a closed position thereby covering the underlying space, and at least one open position. The shading blades are also movable between at least one open position and a closed position in which they cover the underlying space. Alternatively, the shading blades are movable between at least two open positions. The shading blades for example rotate between at least two open positions. The movement of the shading blades between the closed position and at least one open position or between at least two open positions can happen abruptly at once. Alternatively, the movement of the shading blades between the closed position and at least one open position or between at least two open positions can happen gradually during which an opening between two consecutive shading blades gradually increases when the plurality of shading blades moves between a closed position and at least one open position or when the plurality of shading blades moves between at least one open position and a further open position more open than the first one, or during which an opening between two consecutive shading blades gradually decreases when the plurality of shading blades moves between at least one open position and a closed position or when the plurality of shading blades moves between at least one open position and a further open position less open than the first one.

The shading system according to the present invention relates to the field of example pergolas. A pergola is for example a garden feature forming a shaded walkway, passageway, or sitting area of vertical posts or pillars that usually support the housing and the plurality of shading blades. Alternatively, the shading system according to the present invention relates to the field of awnings or blinds comprising rotatable lamellae or roofs of verandas. Alternatively, the shading system according to the present invention relates to the field of louver drive systems.

The first rail according to the present invention comprises a first longitudinal axis along the longitudinal housing direction. In other words, the first rail according to the present invention extends along the longitudinal housing direction. The second rail according to the present invention comprises a second longitudinal axis along the longitudinal housing direction. In other words, the second rail according to the present invention extends along the longitudinal housing direction. The expression "extending along a direction" is understood in the context of the present invention as "comprising a respective axis along the direction". In other words, the expression "extending along a direction" is understood as "being arranged and being parallel to the direction".

This way, the risk that rainwater re-ascends from the gutter to the shading blades is minimized in a simple manner, thereby ensuring the space underlying the shading device stays dry. Indeed, as the coupling element limits a translation of the second rail along the longitudinal housing direction when the actuator translates the first rail along the longitudinal housing direction, the space required by the shading blades to carry out a complete rotation between a closed position and at least one open position is minimized. This way, a distance between the shading blades and the rain gutter is minimized and droplets and/or splashes of rainwater are prevented from splashing from the gutter and from falling outside the gutter on the underlying space.

According to an optional aspect of the invention, the rain gutter comprises a rain gutter coupling element adapted to couple the rain gutter to the housing and a protecting element extending along the longitudinal housing direction; wherein the protecting element is arranged traverse to the longitudinal blade direction such that shading blades partially overlap the rain gutter along the longitudinal blade direction.

This way, the protecting element prevents rainwater from re-ascending from the gutter to the shading blades, thereby ensuring the space underlying the shading device stays dry. Additionally, the protecting element extends along the longitudinal housing direction, and preferably along the entire length of the shading system along the longitudinal housing direction. The protecting element thereby protects the underlying space in a simple manner and for all the shading blades of the shading system according to the present invention. An individual drip catcher tab need not be mounted on each of the shading blades. Additionally, the protecting element thereby protects the mechanism of the shading system by ensuring that no dirt enters the housing of the shading system and jeopardizes its functioning. This increases the lifetime of the shading system and minimizes the need for maintenance.

According to an optional aspect of the invention, each of the shading blades comprises:

- a strip extending along the longitudinal blade direction, wherein the strip comprises the second coupling point; and
- a blade holder comprising:
  - a blade holder body configured to support the strip along the longitudinal blade direction;
  - a first blade holder tip comprising the first coupling point; and
  - a second blade holder tip opposite the first blade holder tip.

A plurality of shading blades are arranged one after the other along the longitudinal housing direction, each of the shading blades extending along a longitudinal blade direction traverse to said longitudinal housing direction and the shading blades being movable between a closed position in which the shading blades are arranged partially superimposed, each over the next, thereby covering the underlying space, and at least one open position in which the shading blades are arranged each spaced from the next by an opening. This way, the shading system is made water tight and the space underlying the shading blades stays dry when the shading blades are in a closed position.

Each shading blade is coupled along a direction traverse to the longitudinal blade direction on one end to the first rail and on another end to the second rail.

According to an optional aspect of the invention, the shading blades are in the closed position, the shading blades are arranged partially superimposed, each over the next, with the second blade holder tip of a shading blade partially superimposing the first blade holder tip of the next shading blade along the longitudinal housing direction.

This way, the shading system is made water tight and the space underlying the shading blades stays dry when the shading blades are in a closed position.

According to an optional aspect of the invention, the shading blades are in the open position, the shading blades are arranged each spaced from the next by an opening formed between the second blade holder tip of a shading blade and the first blade holder tip of the next shading blade along the longitudinal housing direction.

This way, the shading system allows light and other weathering agents to reach the underlying space under the shading blades of the shading system when the shading blades are arranged spaced from the next by an opening.

According to an optional aspect of the invention, the shading blades rotate between the closed position and the open position at the first coupling point around a first rotation axis extending along the longitudinal blade direction.

According to an optional aspect of the invention, when the coupling element limits the translation of the second rail along the longitudinal housing direction, the second rail moves along a traverse direction traverse to the longitudinal housing direction and to the longitudinal blade direction.

This way, each shading blade comprises two coupling points on each end of the shading blade along a direction traverse to the longitudinal blade direction: a first coupling point to the first rail and a second coupling point to the second rail. Both coupling points of each shading blade form a rotation point for the corresponding shading blade. In other words, the translation movement required to rotate each shading blade between the closed position and the open position or vice versa is much shorter than the translation movement required in the covering apparatus of EP3015618A1 to rotate a covering blade using only one fixed rotation point and an orientation guide.

According to an optional aspect of the invention, the first rail comprises:

- a holder extending along the longitudinal housing direction and connected to each of the blade holders at each of the first coupling points; wherein the holder comprises at least one pair of wheels configured to translate along the longitudinal housing direction; and a guide coupled to the holder and extending along the longitudinal housing direction; wherein the guide is configured to guide the pair of wheels along the longitudinal housing direction;

and wherein the actuator is coupled to the holder.

This way, the first and the second rails can translate with respect to each other in a smooth way and without mechanical friction. This ensures that neither the first nor the second rail get damaged when translating and that the rotation of the shading blades happens in a continuous smooth movement, thereby improving the experience of a person positioned in the underlying space.

Alternatively, the shading system comprises a first rail and a second rail and further comprises a polymer profile positioned between the first rail and the second rail such that the second rail slides on the polymer profile along the longitudinal housing direction when the first rail translates along the longitudinal housing direction. The polymer profile for example comprises PVC and/or any other suitable polymer.

According to an optional aspect of the invention, the protecting element of the rain gutter comprises a brush extending along the longitudinal housing direction; wherein the brush is arranged such that each of the blade holders lies onto the brush in the closed position.

This way, the shading blades are brushed when moved between a closed position and at least one open position or between at least one open position and a closed position, thereby ensuring the shading blades stay clean and no dirt falls from the shading blades inside the mechanism of the shading system which could jeopardize its functioning. Additionally, the brush is adapted to retain and collect droplets of water which may fall from the shading blades in the underlying space, thereby preventing the droplets of water from falling in the underlying space and keeping the underlying space dry.

According to an optional aspect of the invention, the coupling element is a rod.

This way, the design and the mounting of the shading system is made robust, simple and the costs associated are minimized.

According to a second aspect of the invention, there is provided a method for covering an underlying space, the method comprising the steps of:

providing a housing extending along a longitudinal housing direction;

providing a plurality of shading blades;

arranging the shading blades one after the other along the longitudinal housing direction, each of the shading blades extending along a longitudinal blade direction traverse to the longitudinal housing direction; the shading blades being movable between a closed position thereby covering the underlying space, and at least one open position;

providing a coupling system arranged between the housing and the plurality of shading blades, wherein providing a coupling system comprises:

providing a first rail comprising a first longitudinal axis along the longitudinal housing direction configured to translate along the longitudinal housing direction;

providing a second rail comprising a second longitudinal axis along the longitudinal housing direction;

wherein each of the shading blades is rotatably coupled to the first rail at a first coupling point and rotatably coupled to the second rail at a second coupling point; and providing a coupling element rotatably coupled to the housing and rotatably coupled to the second rail;

translating the first rail along the longitudinal housing direction; whereby using the coupling element to limit a translation of the second rail along the longitudinal housing direction, thereby rotating the shading blades between the closed position and the at least one open position; and providing a rain gutter extending along the longitudinal housing direction and arranged below the plurality of shading blades.

This way, all the shading blades of the shading system according to the present invention simultaneously rotate between a closed position and at least one open position or between at least one open position and a closed position. Indeed, all the shading blades are rotatably coupled to the same first rail and are also all rotatably coupled to the same second rail such that the rotation of all the shading blades is coordinated and simultaneous. In other words, there is no need with the shading system according to the present invention to foresee the manufacturing and/or the mounting of individual coupling elements between each of the shading blades and the housing of the shading system. The design of the shading system according to the present invention is therefore simple. Additionally, the design of the shading system according to the present invention is compact. Indeed, each shading blade comprises two coupling points on each end of the shading blade along a direction traverse to the longitudinal blade direction: a first coupling point to the first rail and a second coupling point to the second rail. Both coupling points of each shading blade form a rotation point for the corresponding shading blade. In other words, the translation movement required to rotate each shading blade between the closed position and the open position or vice versa is much shorter than the translation movement required in the covering apparatus of EP3015618A1 to rotate a covering blade using only one fixed rotation point and an orientation guide. With the shading system according to the present invention, there is no need to foresee orientation guides in the housing of the shading system to ensure a complete rotation of the shading blades: when the actuator translates the first rail along the longitudinal housing direction, the simultaneous rotation of all the shading blades is achieved when the coupling element of the shading system holds a translation of the second rail along the longitudinal direction back, in other words limits a translation of the second rail along the longitudinal housing direction.

DETAILED DESCRIPTION OF EMBODIMENT(S)

Figure 1:
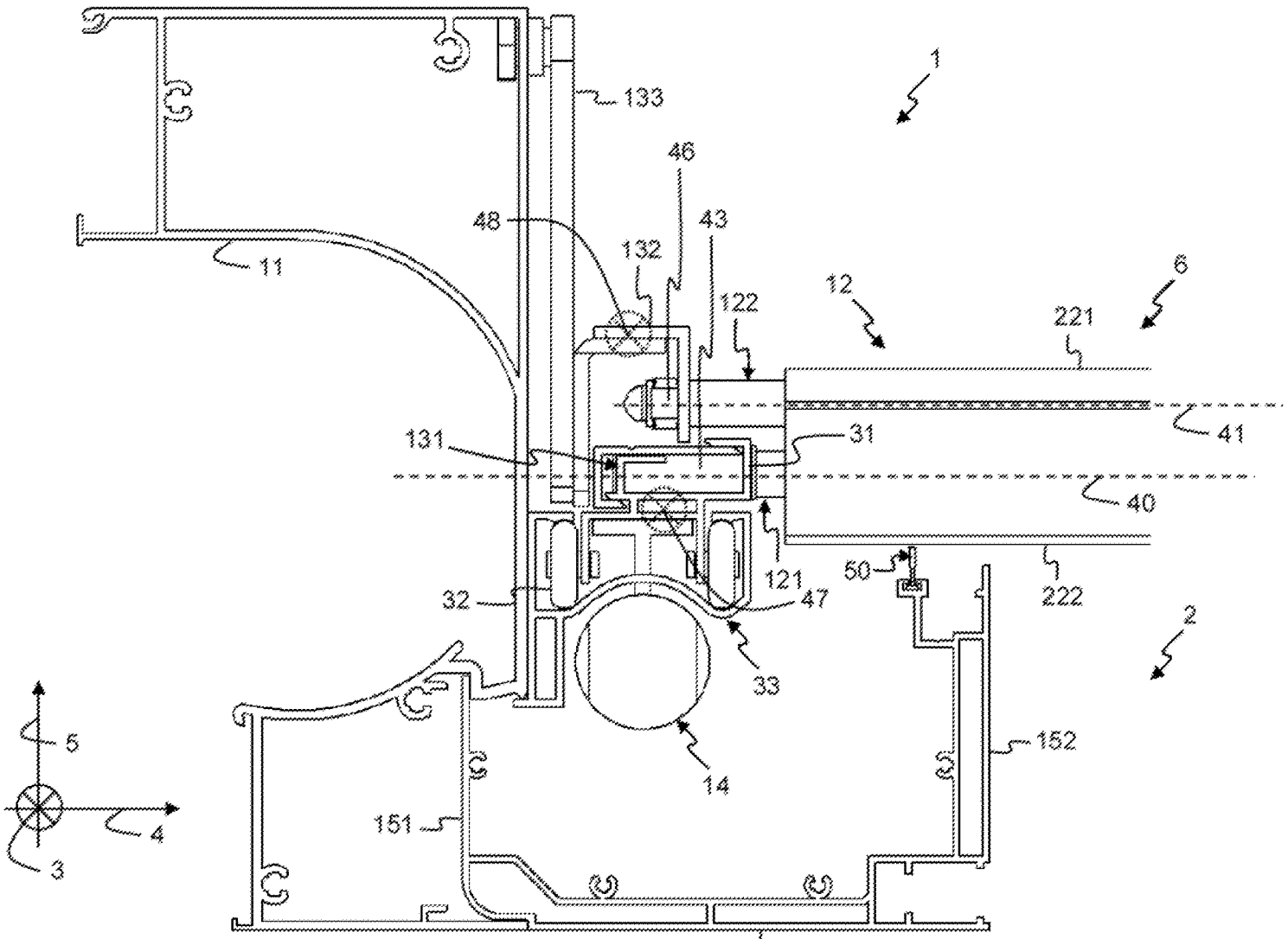
FIG. 1 schematically illustrates a cross-section of an embodiment of a shading system according to the present invention wherein the shading blades are in a closed position.

According to a cross-section of an embodiment shown in FIG. 1, a shading system 1 for covering an underlying space 2 according to the present invention comprises a housing 11, a plurality of shading blades 12, a coupling system and an actuator 14. For clarity reasons, only a part of the shading system 1 is schematically illustrated. The shading system 1 is symmetric with respect to the plurality of shading blade 12 along the longitudinal blade direction 4. The housing 11 extends along a longitudinal housing direction 3. The shading blades 12 are arranged one after the other along the longitudinal housing direction 3, each of the shading blades 12 extending along a longitudinal blade direction 4 traverse to the longitudinal housing direction 3. The shading blades 12 are being movable between a closed position 6 in which the shading blades 12 cover the underlying space 2 and at least one open position. The coupling system is arranged between the housing 11 and the plurality of shading blades 12. The coupling system comprises a first rail 131, a second rail 132 and a coupling element 133. The first rail 131 extends along the longitudinal housing direction 3 and the first rail 131 translates along the longitudinal housing direction 3. The first rail 131 is coupled the housing 11. The second rail 132 extends along the longitudinal housing direction 3. Each of the shading blades 12 is rotatably coupled to the first rail 131 at a first coupling point 121 and each of the shading blades 12 is also rotatably coupled to the second rail 132 at a second coupling point 122. Each of the shading blades 12 comprises a first rotating pin 43 which fits in a respective recess of the first rail 131 at the respective first coupling point 121 such that the respective shading blade 12 can rotate around a first rotation axis 40 at the first coupling point 121. Additionally, each of the shading blades 12 comprises a second rotating pin 46 which is coupled to the second rail 132 at the respective second coupling point 122 such that the respective shading blade 12 can rotate around a second rotation axis 41 at the second coupling point 122. The coupling element 133 is rotatably coupled to the housing 11 and the coupling element 133 is also rotatably coupled to the second rail 132. The actuator 14 translates the first rail 131 along the longitudinal housing direction 3. The coupling element 133 limits a translation of the second rail 132 along the longitudinal housing direction 3, thereby rotating the shading blades 12 between the closed position 6 and at least one of the open positions. The shading system 1 further comprises a rain gutter 15 extending along the longitudinal housing direction 3 and arranged below the plurality of shading blades 12. The rain gutter 15 comprises a rain gutter coupling element 151 which couples the rain gutter 15 to the housing 11 and a protecting element 152 which extends along the longitudinal housing direction 3. The protecting element 152 is arranged traverse to the longitudinal blade direction 4 such that the shading blades 12 partially overlap with the rain gutter 15 along the longitudinal blade direction 4. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 1, the shading blades 12 are arranged partially superimposed, each over the next, with the second blade holder tip 225 of a shading blade 12 partially superimposing the first blade holder tip 224 of the next shading blade 12 along the longitudinal housing direction 4. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. In the closed position 7, the shading blades 12 are such that an angle equal to 0 degree is formed between the longitudinal blade direction 4 of each of the blades of the shading blades 12 and the longitudinal housing direction 3. The shading blades 12 can rotate such that the angle of rotation of each shading blade 12 with respect to the longitudinal housing direction 3 is comprised between 0 degrees and 140 degrees. For example, the shading blades 12 can rotate such that an angle of 10, 20, 25, 30, 40, 50, 60, 70, 80, 90, 100, 110, 120, 130 or 140 degrees is formed between each of the shading blades 12 and the longitudinal housing direction 3 corresponding to the respective closed position 7 of each of the shading blades 12. According to an alternative embodiment, the shading blades 12 can rotate such that the angle of rotation of each shading blade 12 with respect to the longitudinal housing direction 3 is comprised between 0 degrees and 180 degrees. For example, the shading blades 12 can rotate such that an angle comprised between 0 and 180 degrees is formed between each of the shading blades 12 and the longitudinal housing direction 3 corresponding to the respective closed position 7 of each of the shading blades 12. In other words, the movement of the second rail with respect to the first rail causes the shading blades to move towards either an open position 6 or a closed position 7 depending upon the rotational direction of the first coupling point 121 and the rotational direction of the second coupling point 122. The first rail 131 comprises a holder 31 and a guide 33. The holder 31 extends along the longitudinal housing direction 3 and is connected to each of the blade holders 222 at each of the first coupling points 121. The holder 31 comprises at least one pair of wheels 32 which can translate along the longitudinal housing direction 3. The guide 33 is coupled to the holder 31. The guide 33 extends along the longitudinal housing direction 3 and the guide 33 is coupled to the housing 11. The guide 33 guides the pair of wheels 32 along the longitudinal housing direction 3. The actuator 14 is coupled to the holder 31 and thereby translates the holder 31 of the first rail 131. In other words, the holder 31 translates in the guide 33 along the longitudinal housing direction 3. The protecting element 152 of the rain gutter 15 further comprises a brush 50 which extends along the longitudinal housing direction 3. The brush 50 is arranged such that each of the blade holders 222 lies onto the brush 50 when the shading blades 12 are in a closed position 6. The coupling element 133 is for example a rod. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3. The first rail 131 comprises U-shaped profiles and the second rail 132 comprises a L-shaped profile. According to alternative embodiments, the first rail 131 and/or the second rail 132 comprise one or more U-shaped, T-shaped, L-shaped or any other suitable shaped profiles such as for example closed shaped profiles.

Figure 2:
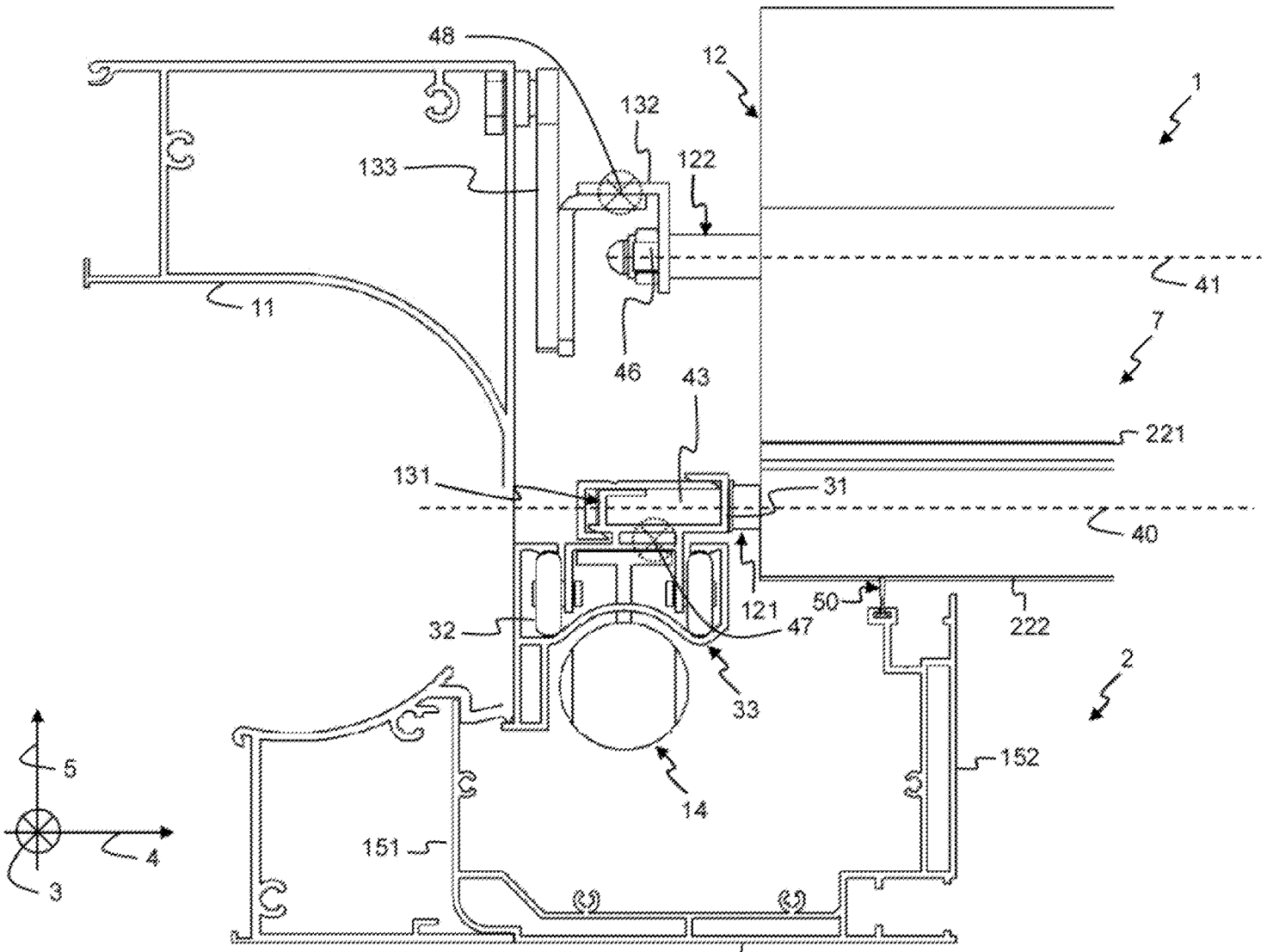
FIG. 2 schematically illustrates a cross-section of an embodiment of a shading system according to the present invention wherein the shading blades are in an open position.

According to a cross-section of an embodiment shown in FIG. 2, a shading system 1 for covering an underlying space 2 according to the present invention comprises a housing 11, a plurality of shading blades 12, a coupling system and an actuator 14. Components having identical reference numbers than in FIG. 1 fulfil the same functions. For clarity reasons, only a part of the shading system 1 is schematically illustrated. The shading system 1 is symmetric with respect to the plurality of shading blade 12 along the longitudinal blade direction 4. The housing 11 extends along a longitudinal housing direction 3. The shading blades 12 are arranged one after the other along the longitudinal housing direction 3, each of the shading blades 12 extending along a longitudinal blade direction 4 traverse to the longitudinal housing direction 3. The shading blades 12 are being movable between a closed position in which the shading blades 12 cover the underlying space 2 and at least one open position 7. The coupling system is arranged between the housing 11 and the plurality of shading blades 12. The coupling system comprises a first rail 131, a second rail 132 and a coupling element 133. The first rail 131 extends along the longitudinal housing direction 3 and the first rail 131 translates along the longitudinal housing direction 3. The second rail 132 extends along the longitudinal housing direction 3. Each of the shading blades 12 is rotatably coupled to the first rail 131 at a first coupling point 121 and each of the shading blades 12 is also rotatably coupled to the second rail 132 at a second coupling point 122. Each of the shading blades 12 comprises a first rotating pin 43 which fits in a respective recess of the first rail 131 at the respective first coupling point 121 such that the respective shading blade 12 can rotate around a first rotation axis 40 at the first coupling point 121. Additionally, each of the shading blades 12 comprises a second rotating pin 46 which is coupled to the second rail 132 at the respective second coupling point 122 such that the respective shading blade 12 can rotate around a second rotation axis 41 at the second coupling point 122. The coupling element 133 is rotatably coupled to the housing 11 and the coupling element 133 is also rotatably coupled to the second rail 132. The actuator 14 translates the first rail 131 along the longitudinal housing direction 3. The coupling element 133 limits a translation of the second rail 132 along the longitudinal housing direction 3, thereby rotating the shading blades 12 between the closed position and at least one of the open positions 7. The shading system 1 further comprises a rain gutter 15 extending along the longitudinal housing direction 3 and arranged below the plurality of shading blades 12. The rain gutter 15 comprises a rain gutter coupling element 151 which couples the rain gutter 15 to the housing 11 and a protecting element 152 which extends along the longitudinal housing direction 3. The protecting element 152 is arranged traverse to the longitudinal blade direction 4 such that the shading blades 12 partially overlap with the rain gutter 15 along the longitudinal blade direction 4. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 2, the shading blades 12 are arranged each spaced from the next one along the longitudinal housing direction 3 by an opening formed by the second blade holder tip 225 of a shading blade 12 and the first blade holder tip 224 of the next shading blade 12 along the longitudinal housing direction 3. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. The first rail 131 comprises a holder 31 and a guide 33. The holder 31 extends along the longitudinal housing direction 3 and is connected to each of the blade holders 222 at each of the first coupling points 121. The holder 31 comprises at least one pair of wheels 32 which can translate along the longitudinal housing direction 3. The guide 33 is coupled to the holder 31. The guide 33 extends along the longitudinal housing direction 3 and the guide 33 is coupled to the housing 11. The guide 33 guides the pair of wheels 32 along the longitudinal housing direction 3. The actuator 14 is coupled to the holder 31 and thereby translates the holder 31 of the first rail 131. The protecting element 152 of the rain gutter 15 further comprises a brush 50 which extends along the longitudinal housing direction 3. The brush 50 is arranged such that each of the blade holders 222 lies onto the brush 50 when the shading blades 12 are in a closed position 6. The coupling element 133 is for example a rod. When the coupling element 133 limits the translation of the second rail 132 along the longitudinal housing direction 3, the second rail 132 moves along a traverse direction 5 traverse to the longitudinal housing direction 3 and to the longitudinal blade direction 4. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3.

Figure 3:
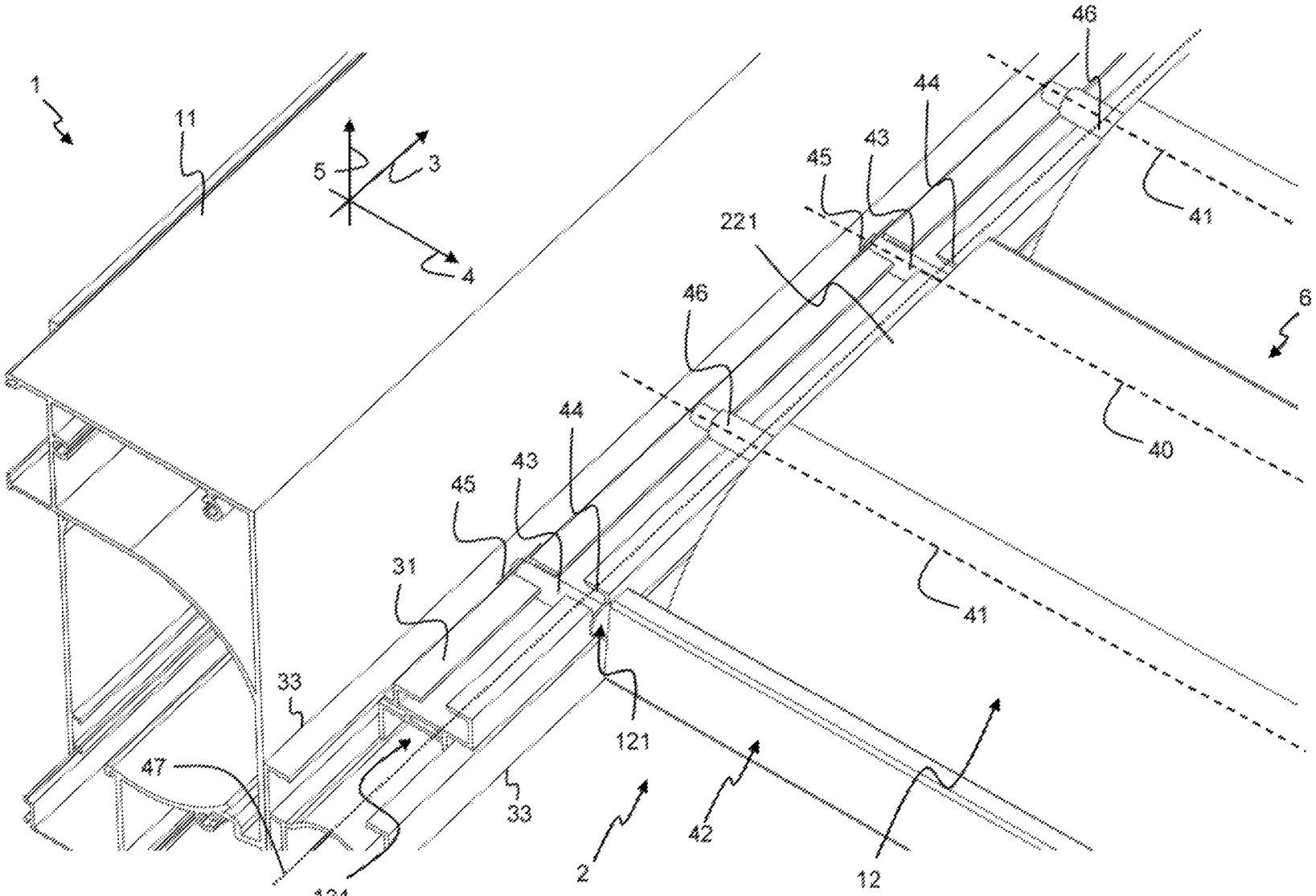
FIG. 3 schematically illustrates a side view of a cross-section of an embodiment of a first rail and of first coupling points according to the present invention.

According to a side view of an embodiment shown in FIG. 3, a shading system 1 for covering an underlying space 2 according to the present invention comprises a housing 11, a plurality of shading blades 12 and a coupling system. Components having identical reference numbers than in FIG. 1 and FIG. 2 fulfil the same functions. The shading system 1 is symmetric with respect to the plurality of shading blade 12 along the longitudinal blade direction 4. The housing 11 extends along a longitudinal housing direction 3. For clarity reasons, only a part of the shading system 1 is schematically illustrated. For example, the shading system 1 further comprises a rain gutter extending along a longitudinal housing direction 3 and arranged below the plurality of shades 12. For clarity reasons, the rain gutter is not illustrated on FIG. 3. The shading blades 12 further comprises a closing lip 42 arranged at the start of the plurality of shading blades 12 in the shading system 1 along the longitudinal housing direction 3. The closing lip 42 seals the plurality of shading blades 12 when the shading system 1 is in a closed position 6, thereby ensuring the underlying space remains dry and protected. Similarly, the plurality of shading blades 12 also comprises a closing lip arranged at the end of the plurality of shading blades 12 in the shading system 1 along the longitudinal housing direction 3. The shading blades 12 are arranged one after the other along the longitudinal housing direction 3, each of the shading blades 12 extending along a longitudinal blade direction 4 traverse to the longitudinal housing direction 3. The shading blades 12 and the closing lips 42 are being movable between a closed position 6 in which the shading blades 12 cover the underlying space 2 and at least one open position. The coupling system is arranged between the housing 11 and the plurality of shading blades 12. The coupling system comprises a first rail 131. The first rail 131 extends along the longitudinal housing direction 3 and the first rail 131 translates along the longitudinal housing direction 3. Each of the shading blades 12 and the closing lip 42 are rotatably coupled to the first rail 131 at a first coupling point 121. The first rail 131 comprises a plurality of recesses 44 periodically defined along the longitudinal housing direction 3. The recesses 44 are defined in the holder 31 of the first rail 31. Each of the shading blades 12 and the closing lip 42 comprise a first rotating pin 43 which fits in a respective recess 44 of the first rail 131 at the respective first coupling point 121 such that the respective shading blade 12 can rotate around a first rotation axis 40 at the first coupling point 121. In other words, the rotating pin 43 rotates in the recess 44 of the first rail 131. Additionally, a locking plate 45 is mounted on the first rail 131 for each of the rotating pins 43 such that the respective shading blade 12 is fixed in a secure manner to the first rail 131. Additionally, each of the shading blades 12 comprises a second rotating pin 46 which is coupled to the second rail at the respective second coupling point 122 such that the respective shading blade 12 can rotate around a second rotation axis 41 at the second coupling point 122. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 3, the shading blades 12 are arranged partially superimposed, each over the next, with the second blade holder tip 225 of a shading blade 12 partially superimposing the first blade holder tip 224 of the next shading blade 12 along the longitudinal housing direction 4. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. The first rail 131 comprises a holder 31 and a guide 33. The holder 31 extends along the longitudinal housing direction 3 and is connected to each of the blade holders 222 at each of the first coupling points 121. The guide 33 is coupled to the holder 31. The guide 33 extends along the longitudinal housing direction 3 and the guide 33 is coupled to the housing 11. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3.

Figure 4:
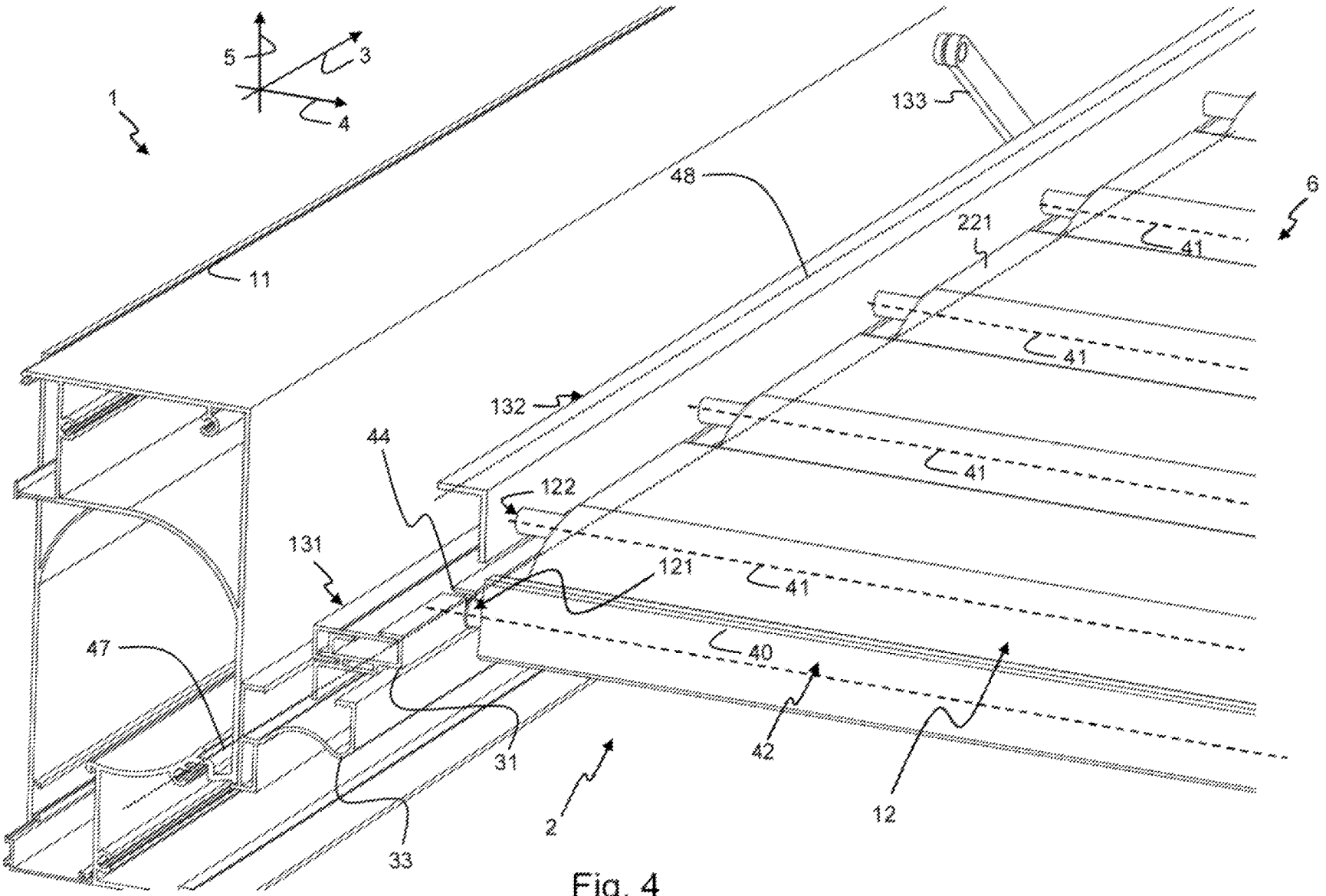
FIG. 4 schematically illustrates a side view of a cross-section of an embodiment of a shading system according to the present invention.

According to a side view of an embodiment shown in FIG. 4, a shading system 1 for covering an underlying space 2 according to the present invention comprises a housing 11, a plurality of shading blades 12 and a coupling system. Components having identical reference numbers than in FIG. 1 and FIG. 2 and FIG. 3 fulfil the same functions. The shading system 1 is symmetric with respect to the plurality of shading blade 12 along the longitudinal blade direction 4. The housing 11 extends along a longitudinal housing direction 3. For clarity reasons, only a part of the shading system 1 is schematically illustrated. For example, the shading system 1 further comprises a rain gutter extending along a longitudinal housing direction 3 and arranged below the plurality of shades 12. For clarity reasons, the rain gutter is not illustrated on FIG. 3. The shading blades 12 further comprises a closing lip 42 arranged at the start of the plurality of shading blades 12 in the shading system 1 along the longitudinal housing direction 3. The closing lip 42 seals the plurality of shading blades 12 when the shading system 1 is in a closed position 6, thereby ensuring the underlying space remains dry and protected. Similarly, the plurality of shading blades 12 also comprises a closing lip arranged at the end of the plurality of shading blades 12 in the shading system 1 along the longitudinal housing direction 3. The shading blades 12 are arranged one after the other along the longitudinal housing direction 3, each of the shading blades 12 extending along a longitudinal blade direction 4 traverse to the longitudinal housing direction 3. The shading blades 12 and the closing lips 42 are being movable between a closed position 6 in which the shading blades 12 cover the underlying space 2 and at least one open position. The coupling system is arranged between the housing 11 and the plurality of shading blades 12. The coupling system comprises a first rail 131, a second rail 132 and a coupling element 133. The first rail 131 extends along the longitudinal housing direction 3 and the first rail 131 translates along the longitudinal housing direction 3. The second rail 132 extends along the longitudinal housing direction 3. Each of the shading blades 12 and the closing lip 42 are rotatably coupled to the first rail 131 at a first coupling point 121 and each of the shading blades 12 and the closing lip 42 are also rotatably coupled to the second rail 132 at a second coupling point 122. The first rail 131 comprises a plurality of recesses 44 periodically defined along the longitudinal housing direction 3. The recesses 44 are defined in the holder 31 of the first rail 31. Each of the shading blades 12 and the closing lip 42 comprise a first rotating pin which fits in a respective recess 44 of the first rail 131 at the respective first coupling point 121 such that the respective shading blade 12 can rotate around a first rotation axis 40 at the first coupling point 121. In other words, the rotating pin rotates in the recess 44 of the first rail 131. Additionally, each of the shading blades 12 comprises a second rotating pin which is coupled to the second rail at the respective second coupling point 122 such that the respective shading blade 12 can rotate around a second rotation axis 41 at the second coupling point 122. The coupling element 133 is rotatably coupled to the housing 11 and the coupling element 133 is also rotatably coupled to the second rail 132. The coupling element 133 limits a translation of the second rail 132 along the longitudinal housing direction 3, thereby rotating the shading blades 12 between the closed position 6 and at least one of the open positions. The coupling element 133 is for example a rod. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 4, the shading blades 12 are arranged partially superimposed, each over the next, with the second blade holder tip 225 of a shading blade 12 partially superimposing the first blade holder tip 224 of the next shading blade 12 along the longitudinal housing direction 4. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. The first rail 131 comprises a holder 31 and a guide 33. The holder 31 extends along the longitudinal housing direction 3 and is connected to each of the blade holders 222 at each of the first coupling points 121. The guide 33 is coupled to the holder 31. The guide 33 extends along the longitudinal housing direction 3 and the guide 33 is coupled to the housing 11. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3.

Figure 5A:
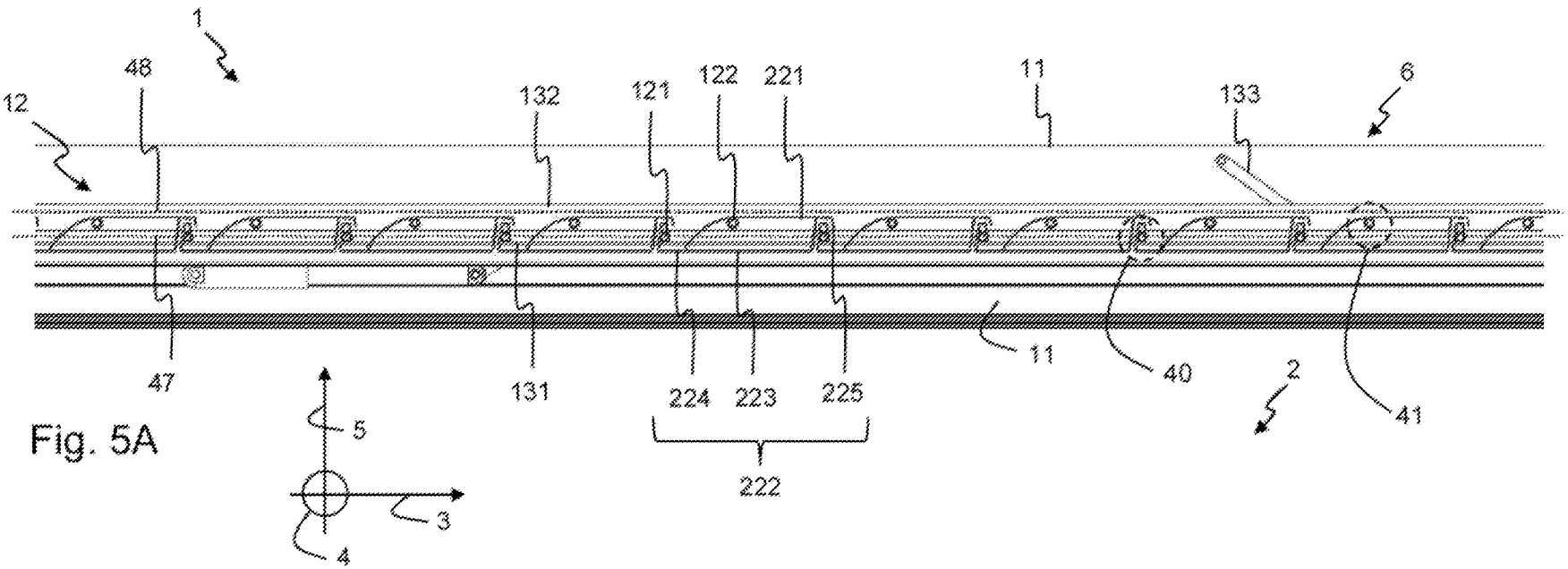
FIGS. 5A to 5F schematically illustrate cross-sections of a shading system according to the present invention wherein the shading blades rotate between a closed position and open positions.
Figure 5B:
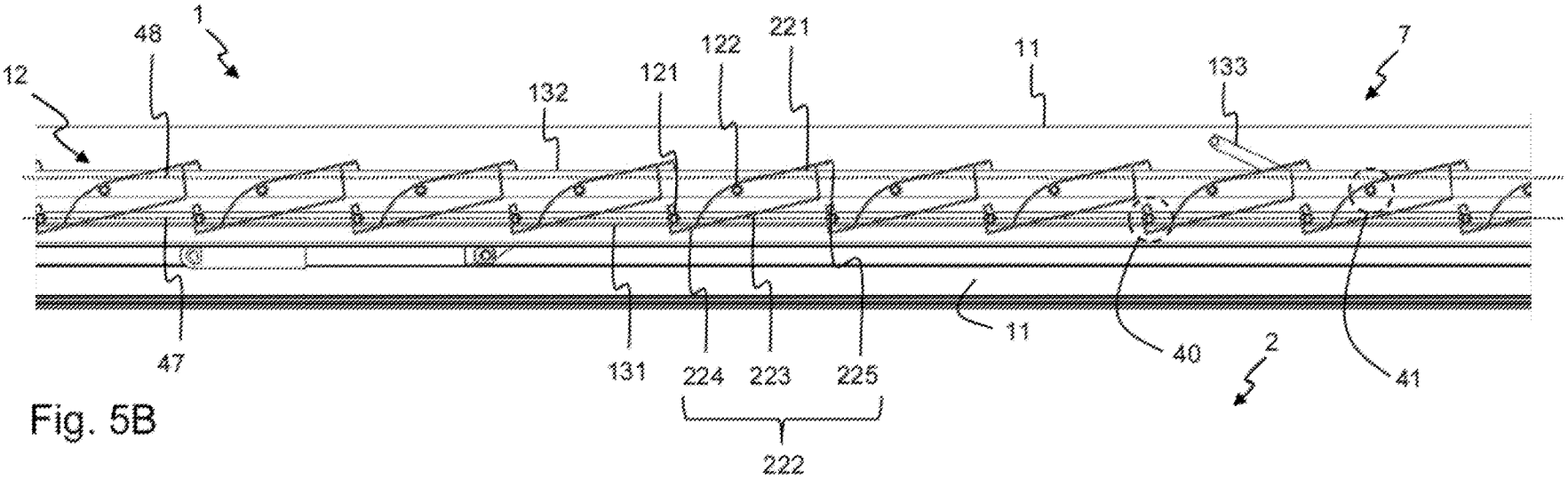
Figure 5C:
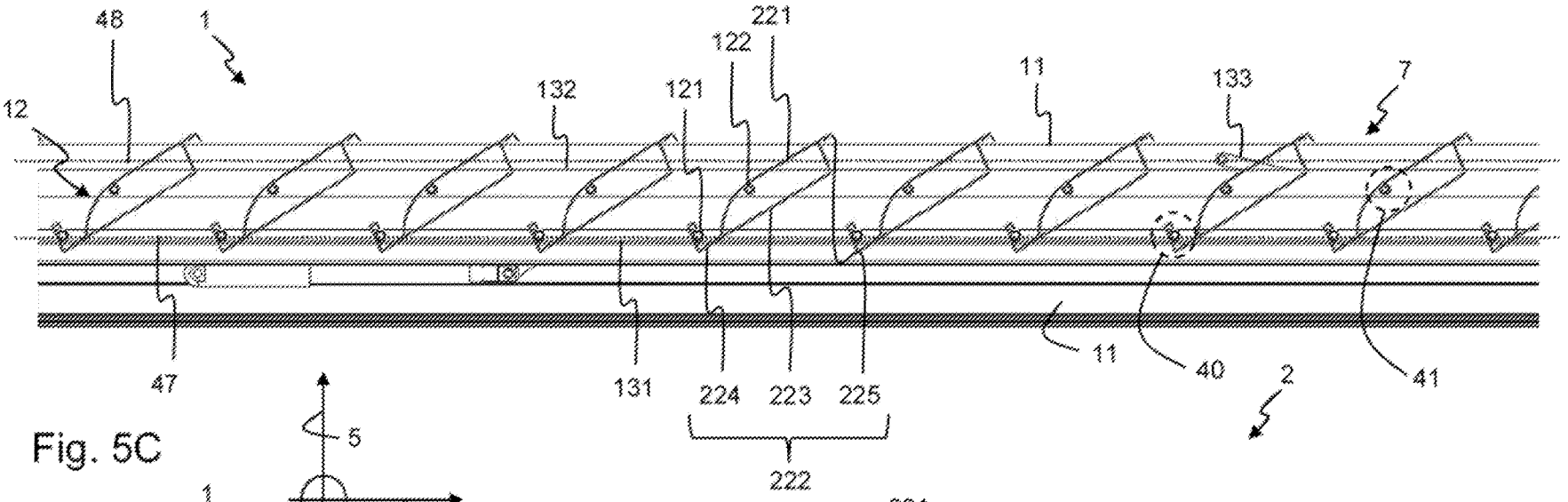
Figure 5D:
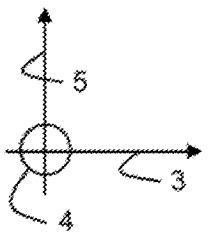
Figure 5D:
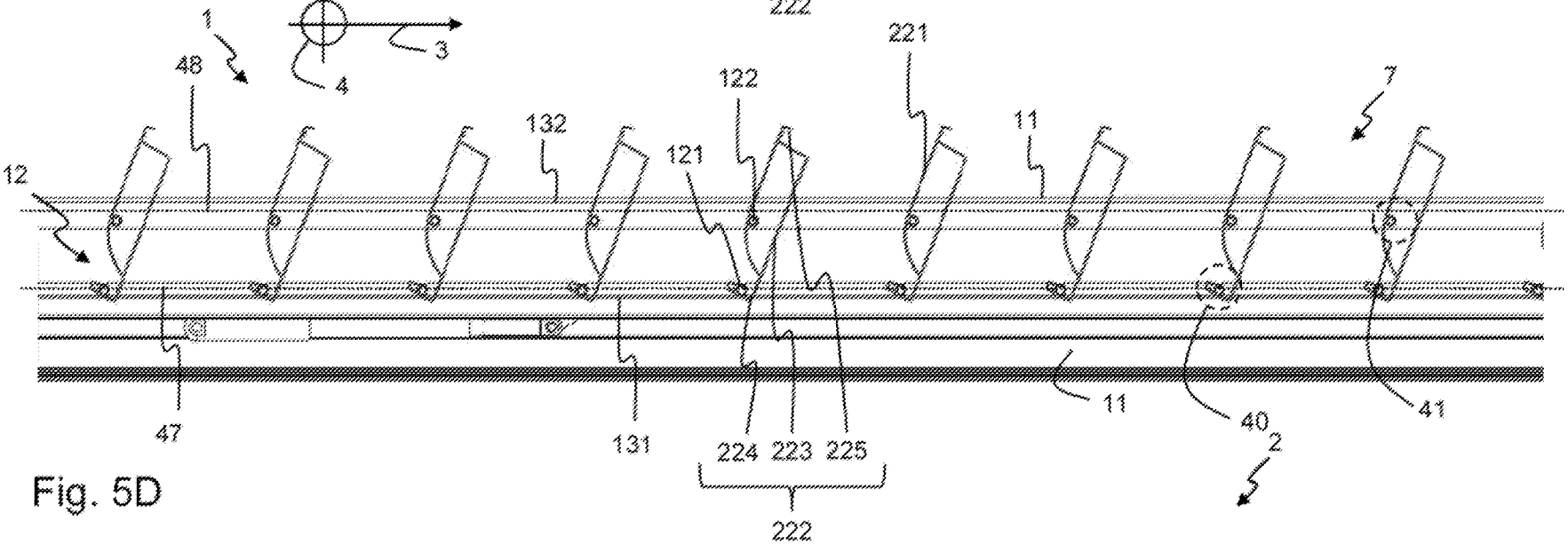
Figure 5E:
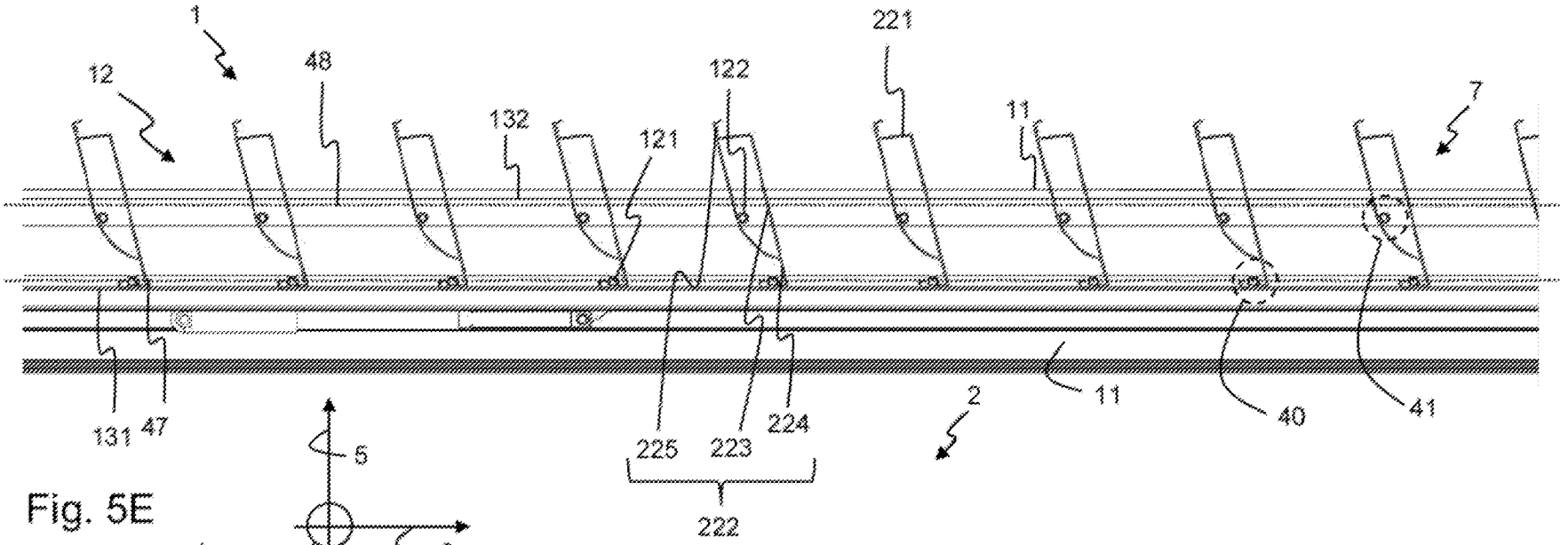
Figure 5F:
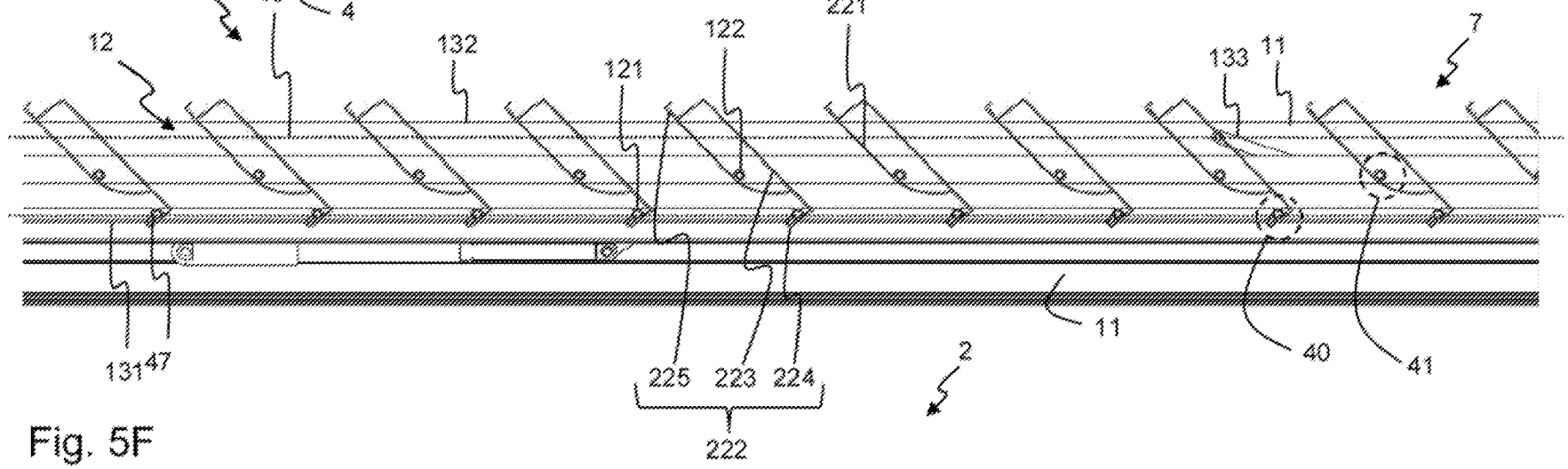

According to a cross-section of an embodiment shown in FIGS. 5A to 5F, a shading system 1 for covering an underlying space 2 according to the present invention comprises a housing 11, a plurality of shading blades 12. Components having identical reference numbers than in FIG. 1 and FIG. 2 and FIG. 3 and FIG. 4 fulfil the same functions. The shading system 1 is symmetric with respect to the plurality of shading blade 12 along the longitudinal blade direction 4. The housing 11 extends along a longitudinal housing direction 3. For clarity reasons, only a part of the shading system 1 is schematically illustrated. For example, the shading system 1 further comprises a rain gutter extending along a longitudinal housing direction 3 and arranged below the plurality of shades 12. For clarity reasons, the rain gutter is not illustrated on FIG. 3. The shading blades 12 are arranged one after the other along the longitudinal housing direction 3, each of the shading blades 12 extending along a longitudinal blade direction 4 traverse to the longitudinal housing direction 3. The shading blades 12 are being movable between a closed position 6 in which the shading blades 12 cover the underlying space 2 and at least one open position. The coupling system is arranged between the housing 11 and the plurality of shading blades 12. The coupling system comprises a first rail 131, a second rail 132 and a coupling element 133. The coupling element 133 is for example a rod. The first rail 131 extends along the longitudinal housing direction 3 and the first rail 131 translates along the longitudinal housing direction 3. The second rail 132 extends along the longitudinal housing direction 3. Each of the shading blades 12 is rotatably coupled to the first rail 131 at a first coupling point 121 and each of the shading blades 12 is also rotatably coupled to the second rail 132 at a second coupling point 122. The coupling element 133 is rotatably coupled to the housing 11 and the coupling element 133 is also rotatably coupled to the second rail 132. An actuator translates the first rail 131 along the longitudinal housing direction 3. The coupling element 133 limits a translation of the second rail 132 along the longitudinal housing direction 3, and the shading blades 12 thereby rotate between the closed position 6 and at least one of the open positions 7. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 5A, the shading blades 12 are arranged partially superimposed, each over the next, with the second blade holder tip 225 of a shading blade 12 partially superimposing the first blade holder tip 224 of the next shading blade 12 along the longitudinal housing direction 4. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. In FIG. 5A, the distance from the first coupling point 121 to the second coupling point 122 of each of the shading blades 12 along a traverse direction 5 traverse to the longitudinal housing direction 3 and traverse to the longitudinal blade direction 4 is minimum. In FIG. 5B, the first rail 131 has been slightly translated along the longitudinal housing direction 3. As each of the shading blades is coupled to the first rail 131 and to the second rail 132, when translating along the longitudinal housing direction 3, the first rail 131 causes a translation of the second rail 132 along the longitudinal housing direction 3. In reaction to the translation of the second rail 132 along the longitudinal housing direction 3, the coupling element 133 limits a translation of the second rail 132 along the longitudinal housing direction 3 and the second rail 132 moves along a traverse direction 5 traverse to the longitudinal housing direction 3 and to the longitudinal blade direction 4. The shading blades 12 thereby rotate between the closed position 6 and a first open position 7 in which the shading blades 12 are arranged each spaced from the next along the longitudinal housing direction 3 by an opening formed between the second blade holder tip 225 of a shading blade 12 and the first blade holder tip 224 of the next shading blade 12. In FIG. 5B, the distance from the first coupling point 121 to the second coupling point 122 of each of the shading blades 12 along a traverse direction 5 traverse to the longitudinal housing direction 3 and traverse to the longitudinal blade direction 4 therefore increases with respect to the respective distance in FIG. 5A. Additionally, in FIG. 5B, the distance from the first coupling point 121 to the second coupling point 122 of each of the shading blades 12 along the longitudinal housing direction 3 therefore decreases with respect to the respective distance in FIG. 5A. In FIG. 5C, the first rail 131 has been further translated along the longitudinal housing direction 3. As each of the shading blades is coupled to the first rail 131 and to the second rail 132, when further translating along the longitudinal housing direction 3, the first rail 131 causes a further translation of the second rail 132 along the longitudinal housing direction 3. In reaction to the further translation of the second rail 132 along the longitudinal housing direction 3, the coupling element 133 further limits the translation of the second rail 132 along the longitudinal housing direction 3 and the second rail 132 further moves along the traverse direction 5 traverse to the longitudinal housing direction 3 and to the longitudinal blade direction 4. The shading blades 12 thereby further rotate between the first open position 7 and a second open position 7 in which the shading blades 12 are arranged each spaced from the next along the longitudinal housing direction 3 by an opening formed between the second blade holder tip 225 of a shading blade 12 and the first blade holder tip 224 of the next shading blade 12 larger than the opening of FIG. 5B. In FIG. 5C, the distance from the first coupling point 121 to the second coupling point 122 of each of the shading blades 12 along a traverse direction 5 traverse to the longitudinal housing direction 3 and traverse to the longitudinal blade direction 4 therefore increases with respect to the respective distance in FIG. 5B. Additionally, in FIG. 5C, the distance from the first coupling point 121 to the second coupling point 122 of each of the shading blades 12 along the longitudinal housing direction 3 therefore decreases with respect to the respective distance in FIG. 5B. In FIG. 5D, the first rail 131 has been further translated along the longitudinal housing direction 3. As each of the shading blades is coupled to the first rail 131 and to the second rail 132, when further translating along the longitudinal housing direction 3, the first rail 131 causes a further translation of the second rail 132 along the longitudinal housing direction 3. In reaction to the further translation of the second rail 132 along the longitudinal housing direction 3, the coupling element 133 further limits the translation of the second rail 132 along the longitudinal housing direction 3 and the second rail 132 further moves along the traverse direction 5 traverse to the longitudinal housing direction 3 and to the longitudinal blade direction 4. The shading blades 12 thereby further rotate between the second open position 7 and a third open position 7 in which the shading blades 12 are arranged each spaced from the next along the longitudinal housing direction 3 by an opening formed between the second blade holder tip 225 of a shading blade 12 and the first blade holder tip 224 of the next shading blade 12 larger than the opening of FIG. 5C. In FIG. 5D, the distance from the first coupling point 121 to the second coupling point 122 of each of the shading blades 12 along a traverse direction 5 traverse to the longitudinal housing direction 3 and traverse to the longitudinal blade direction 4 therefore increases with respect to the respective distance in FIG. 5C, and the second coupling points 122 are almost aligned with the respective first coupling points 121 along the traverse direction 5. Additionally, in FIG. 5D, the distance from the first coupling point 121 to the second coupling point 122 of each of the shading blades 12 along the longitudinal housing direction 3 therefore decreases with respect to the respective distance in FIG. 5C. In FIG. 5E, the first rail 131 has been further translated along the longitudinal housing direction 3. As each of the shading blades is coupled to the first rail 131 and to the second rail 132, when further translating along the longitudinal housing direction 3, the first rail 131 causes a further translation of the second rail 132 along the longitudinal housing direction 3. In reaction to the further translation of the second rail 132 along the longitudinal housing direction 3, the coupling element 133 further limits the translation of the second rail 132 along the longitudinal housing direction 3 and the second rail 132 further moves along the traverse direction 5 traverse to the longitudinal housing direction 3 and to the longitudinal blade direction 4. The shading blades 12 thereby further rotate between the third open position 7 and a fourth open position 7 in which the shading blades 12 are arranged each spaced from the next along the longitudinal housing direction 3 by an opening formed between the second blade holder tip 225 of a shading blade 12 and the first blade holder tip 224 of the next shading blade 12 larger than the opening of FIG. 5D. In FIG. 5E, the distance from the first coupling point 121 to the second coupling point 122 of each of the shading blades 12 along a traverse direction 5 traverse to the longitudinal housing direction 3 and traverse to the longitudinal blade direction 4 therefore increases with respect to the respective distance in FIG. 5D, and the second coupling points 122 are almost aligned with the respective first coupling points 121 along the traverse direction 5. Additionally, in FIG. 5E, the distance from the first coupling point 121 to the second coupling point 122 of each of the shading blades 12 along the longitudinal housing direction 3 therefore decreases with respect to the respective distance in FIG. 5D. In FIG. 5F, the first rail 131 has been further translated along the longitudinal housing direction 3. As each of the shading blades is coupled to the first rail 131 and to the second rail 132, when further translating along the longitudinal housing direction 3, the first rail 131 causes a further translation of the second rail 132 along the longitudinal housing direction 3. In reaction to the further translation of the second rail 132 along the longitudinal housing direction 3, the coupling element 133 further limits the translation of the second rail 132 along the longitudinal housing direction 3 and the second rail 132 further moves along the traverse direction 5 traverse to the longitudinal housing direction 3 and to the longitudinal blade direction 4. The shading blades 12 thereby further rotate between the fourth open position 7 and a fifth open position 7 in which the shading blades 12 are arranged each spaced from the next along the longitudinal housing direction 3 by an opening formed between the second blade holder tip 225 of a shading blade 12 and the first blade holder tip 224 of the next shading blade 12 larger than the opening of FIG. 5E. In FIG. 5F, the distance from the first coupling point 121 to the second coupling point 122 of each of the shading blades 12 along a traverse direction 5 traverse to the longitudinal housing direction 3 and traverse to the longitudinal blade direction 4 therefore increases with respect to the respective distance in FIG. 5E, and the second coupling points 122 are almost aligned with the respective first coupling points 121 along the traverse direction 5. Additionally, in FIG. 5F, the distance from the first coupling point 121 to the second coupling point 122 of each of the shading blades 12 along the longitudinal housing direction 3 therefore decreases with respect to the respective distance in FIG. 5E. The rotation between a closed position and the several open positions and vice versa happens continuously and smoothly. According to an alternative embodiment, the rotation happens gradually in stages. According to an alternative embodiment, when the first rail 131 is translated along a direction opposite to the longitudinal housing direction 3, as each of the shading blades is coupled to the first rail 131 and to the second rail 132, the first rail 131 causes a translation of the second rail 132 along a direction opposite to the longitudinal housing direction 3. In reaction to the translation of the second rail 132 along the longitudinal housing direction 3, the coupling element 133 limits the translation of the second rail 132 along a direction opposite to the longitudinal housing direction 3 and the second rail 132 moves along a direction opposite to the traverse direction 5 traverse to the longitudinal housing direction 3 and to the longitudinal blade direction 4. The shading blades 12 thereby rotate between an open position and another open position in which the shading blades 12 are arranged each spaced from the next along the longitudinal housing direction 3 by an opening formed between the second blade holder tip 225 of a shading blade 12 and the first blade holder tip 224 of the next shading blade 12 smaller than the previous opening. Alternatively, the shading blades 12 thereby rotate between an open position and the closed position 6. The distance from the first coupling point 121 to the second coupling point 122 of each of the shading blades 12 along a traverse direction 5 traverse to the longitudinal housing direction 3 and traverse to the longitudinal blade direction 4 therefore decreases with respect to the previous respective distance. Additionally, the distance from the first coupling point 121 to the second coupling point 122 of each of the shading blades 12 along the longitudinal housing direction 3 therefore increases with respect to the previous respective distance. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3.

Figure 6:
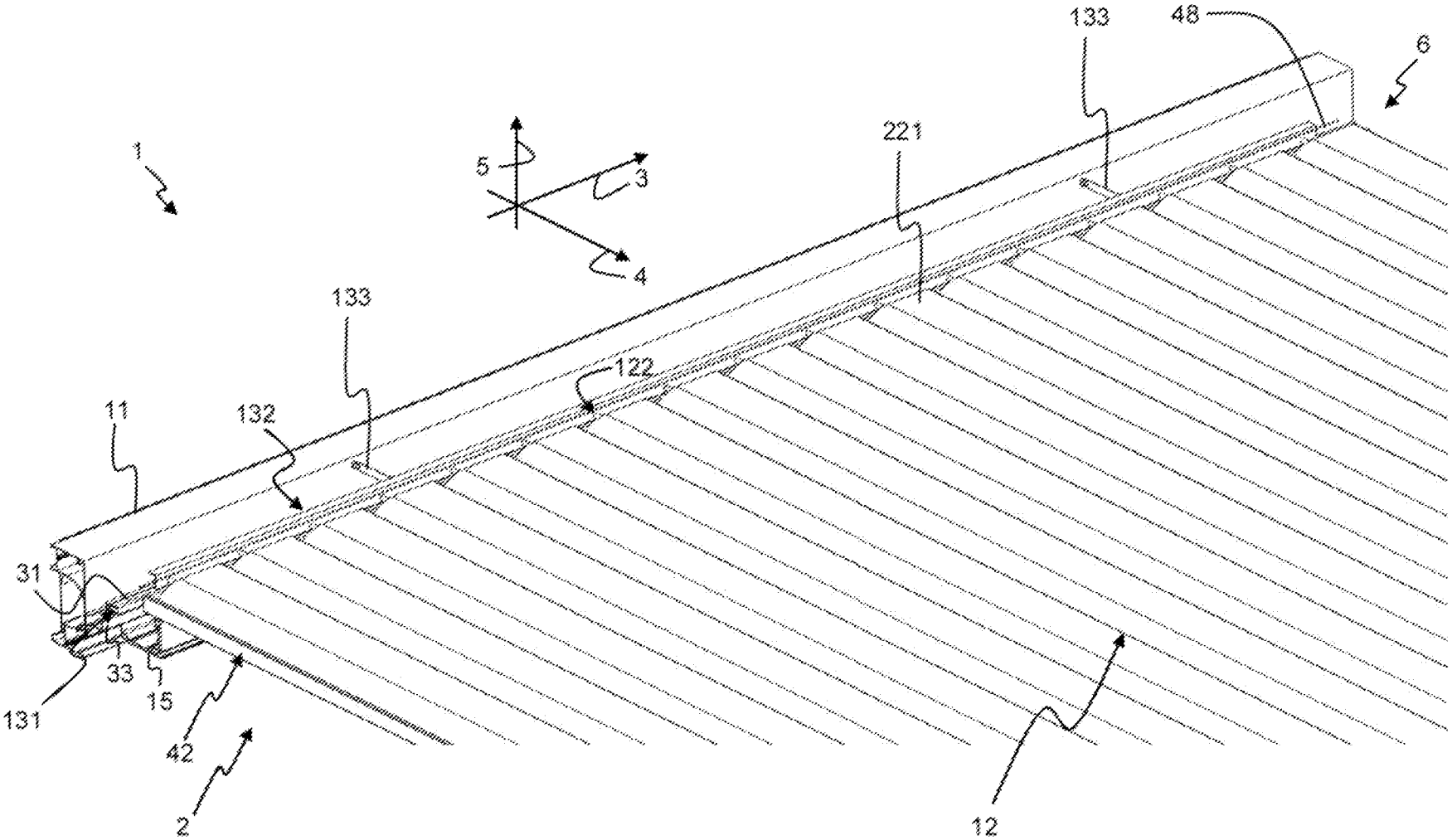
FIG. 6 schematically illustrates a side view of a cross-section of an embodiment of a shading system according to the present invention wherein the shading system comprises two coupling elements.

According to a side view of an embodiment shown in FIG. 6, a shading system 1 for covering an underlying space 2 according to the present invention comprises a housing 11, a plurality of shading blades 12 and a coupling system. Components having identical reference numbers than in FIG. 1 and FIG. 2 and FIG. 3 and FIG. 4 and FIG. 5A to 5F fulfil the same functions. For clarity reasons, only a part of the shading system 1 is schematically illustrated. The shading system 1 is symmetric with respect to the plurality of shading blade 12 along the longitudinal blade direction 4. The housing 11 extends along a longitudinal housing direction 3. The shading system 1 further comprises a rain gutter 15 extending along the longitudinal housing direction 3 and arranged below the plurality of shading blades 12. The rain gutter 15 comprises a rain gutter coupling element which couples the rain gutter 15 to the housing 11 and a protecting element which extends along the longitudinal housing direction 3. The protecting element is arranged traverse to the longitudinal blade direction 4 such that the shading blades 12 partially overlap with the rain gutter 15 along the longitudinal blade direction 4. The shading blades 12 further comprises a closing lip 42 arranged at the start of the plurality of shading blades 12 in the shading system 1 along the longitudinal housing direction 3. The closing lip 42 seals the plurality of shading blades 12 when the shading system 1 is in a closed position 6, thereby ensuring the underlying space remains dry and protected. Similarly, the plurality of shading blades 12 also comprises a closing lip arranged at the end of the plurality of shading blades 12 in the shading system 1 along the longitudinal housing direction 3. The shading blades 12 are arranged one after the other along the longitudinal housing direction 3, each of the shading blades 12 extending along a longitudinal blade direction 4 traverse to the longitudinal housing direction 3. The shading blades 12 and the closing lips 42 are being movable between a closed position 6 in which the shading blades 12 cover the underlying space 2 and at least one open position. The coupling system is arranged between the housing 11 and the plurality of shading blades 12. The coupling system comprises a first rail 131, a second rail 132 and two coupling elements 133. The first rail 131 extends along the longitudinal housing direction 3 and the first rail 131 translates along the longitudinal housing direction 3. The second rail 132 extends along the longitudinal housing direction 3. Each of the shading blades 12 and the closing lip 42 are rotatably coupled to the first rail 131 at a first coupling point 121 and each of the shading blades 12 and the closing lip 42 are also rotatably coupled to the second rail 132 at a second coupling point 122. The first rail 131 comprises a plurality of recesses 44 periodically defined along the longitudinal housing direction 3. The recesses 44 are defined in the holder 31 of the first rail 31. Each of the shading blades 12 and the closing lip 42 comprise a first rotating pin which fits in a respective recess 44 of the first rail 131 at the respective first coupling point 121 such that the respective shading blade 12 can rotate around a first rotation axis 40 at the first coupling point 121. In other words, the rotating pin rotates in the recess 44 of the first rail 131. Additionally, each of the shading blades 12 comprises a second rotating pin which is coupled to the second rail at the respective second coupling point 122 such that the respective shading blade 12 can rotate around a second rotation axis 41 at the second coupling point 122. Each of the coupling elements 133 is rotatably coupled to the housing 11 and each of the coupling elements 133 is also rotatably coupled to the second rail 132. Each of the coupling elements 133 limits a translation of the second rail 132 along the longitudinal housing direction 3, thereby rotating the shading blades 12 between the closed position 6 and at least one of the open positions. Each of the coupling elements 133 is for example a rod. The coupling elements 133 can be identical or different from each other. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 6, the shading blades 12 are arranged partially superimposed, each over the next, with the second blade holder tip 225 of a shading blade 12 partially superimposing the first blade holder tip 224 of the next shading blade 12 along the longitudinal housing direction 4. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. The first rail 131 comprises a holder 31 and a guide 33. The holder 31 extends along the longitudinal housing direction 3 and is connected to each of the blade holders 222 at each of the first coupling points 121. The guide 33 is coupled to the holder. The guide 33 extends along the longitudinal housing direction 3 and the guide 33 is coupled to the housing 11. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3.

Figure 7:
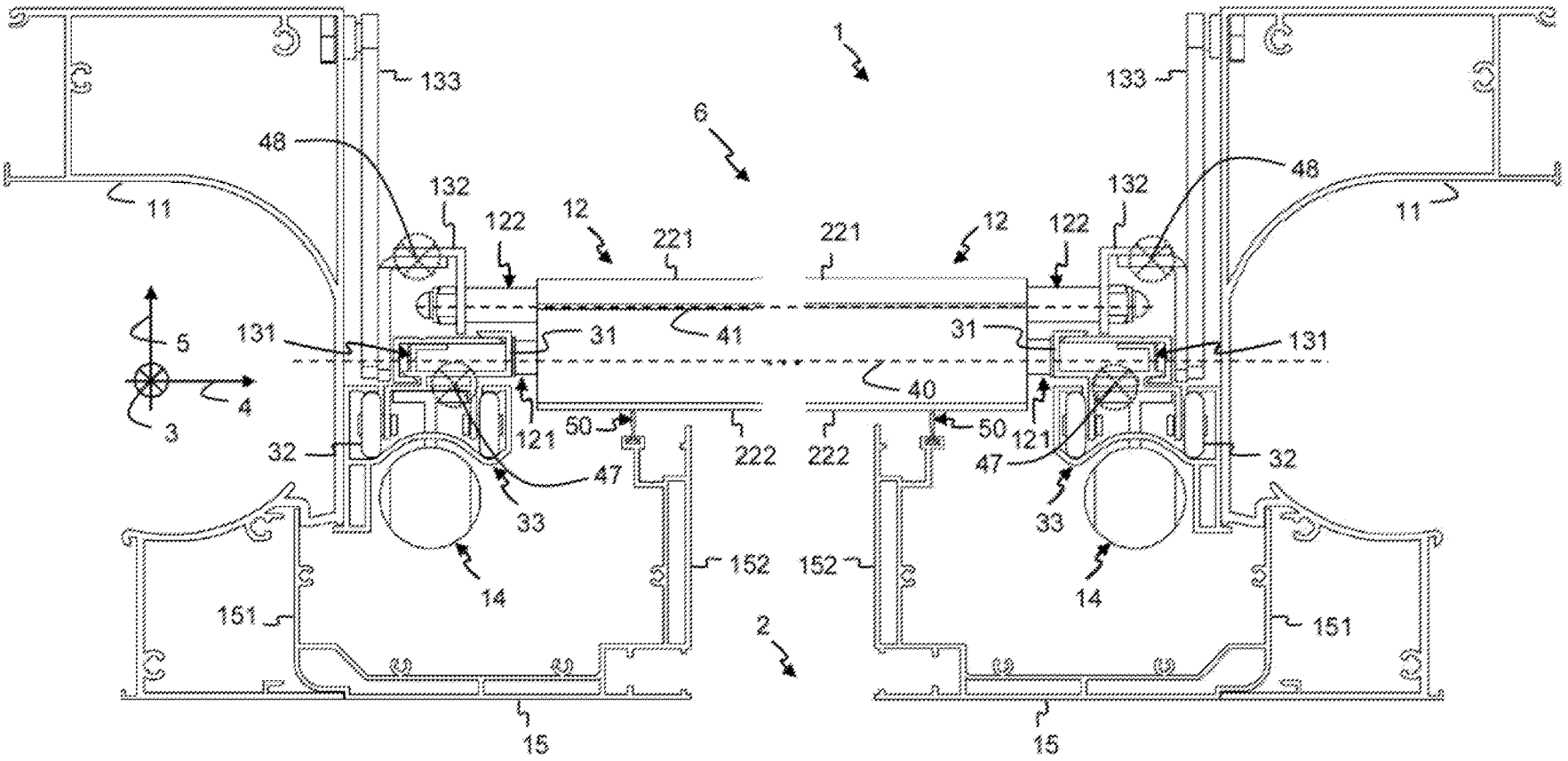
FIG. 7 schematically illustrates a cross-section of an embodiment of a shading system according to the present invention wherein the shading blades are in a closed position.

According to a cross-section of an embodiment shown in FIG. 7, a shading system 1 according to the present invention comprises two housings 11 parallel to each other and to which a plurality of shading blades 12 is coupled. Components having identical reference numbers than in FIG. 1 and FIG. 2 and FIG. 3 and FIG. 4 and FIG. 5A to 5F and FIG. 6 fulfil the same functions. The shading system 1 for covering an underlying space 2 according to the present invention comprises on each side a housing 11, a plurality of shading blades 12, two coupling systems and two actuators 14. According to an alternative embodiment, the shading system 1 comprises one actuator 14. The housings 11 extend along a longitudinal housing direction 3. The shading blades 12 are arranged one after the other along the longitudinal housing direction 3, each of the shading blades 12 extending along a longitudinal blade direction 4 traverse to the longitudinal housing direction 3. The shading blades 12 are being movable between a closed position 6 in which the shading blades 12 cover the underlying space 2 and at least one open position. The coupling systems are arranged between the housings 11 and the plurality of shading blades 12. The coupling systems comprise a first rail 131, a second rail 132 and a coupling element 133. The first rails 131 extend along the longitudinal housing direction 3 and the first rails 131 translate along the longitudinal housing direction 3. The second rails 132 extend along the longitudinal housing direction 3. Each of the shading blades 12 is rotatably coupled to the first rail 131 at a first coupling point 121 and each of the shading blades 12 is also rotatably coupled to the second rail 132 at a second coupling point 122. Each of the shading blades 12 comprises a first rotating pin which fits in a respective recess of the first rail 131 at the respective first coupling point 121 such that the respective shading blade 12 can rotate around a first rotation axis 40 at the first coupling point 121. Additionally, each of the shading blades 12 comprises a second rotating pin 46 which is coupled to the second rail 132 at the respective second coupling point 122 such that the respective shading blade 12 can rotate around a second rotation axis 41 at the second coupling point 122. The coupling elements 133 are rotatably coupled to the housings 11 and the coupling elements 133 are also rotatably coupled to the second rails 132. The actuators 14 translate the first rail 131 along the longitudinal housing direction 3. The coupling elements 133 limit a translation of the second rail 132 along the longitudinal housing direction 3, thereby rotating the shading blades 12 between the closed position 6 and at least one of the open positions. The shading system 1 further comprises two rain gutters 15 extending along the longitudinal housing direction 3 and arranged below the plurality of shading blades 12. The rain gutters 15 comprise a rain gutter coupling element 151 which couples the rain gutter 15 to the housing 11 and a protecting element 152 which extends along the longitudinal housing direction 3. The protecting elements 152 are arranged traverse to the longitudinal blade direction 4 such that the shading blades 12 partially overlap with the rain gutter 15 along the longitudinal blade direction 4. Each of the shading blades 12 comprises a strip 221 and a blade holder 222. Each strip 221 extends along the longitudinal blade direction 4, and each strip 221 comprises the second coupling point 122 of the respective shading blade 12. Each blade holder 223 comprises a blade holder body 223, a first blade holder tip 224 and a second blade holder tip 225. Each blade holder body 223 supports the strip 221 along the longitudinal blade direction 4. Each first blade holder tip 224 comprises the first coupling point 121 of the respective shading blade 12. Each second blade holder tip 225 is arranged opposite each respective first blade holder tip 224. In FIG. 7, the shading blades 12 are arranged partially superimposed, each over the next, with the second blade holder tip 225 of a shading blade 12 partially superimposing the first blade holder tip 224 of the next shading blade 12 along the longitudinal housing direction 4. The shading blades 12 rotate at their first coupling points 121 around a first rotation axis 40 extending along the longitudinal blade direction 4. The shading blades 12 also rotate at their second coupling points 122 around a second rotation axis 41 extending along the longitudinal blade direction 4. The first rails 131 comprise a holder 31 and a guide 33. The holder 31 extends along the longitudinal housing direction 3 and is connected to each of the blade holders 222 at each of the first coupling points 121. The holder 31 comprises at least one pair of wheels 32 which can translate along the longitudinal housing direction 3. The guide 33 is coupled to the holder 31. The guide 33 extends along the longitudinal housing direction 3 and the guide 33 is coupled to the housing 11. The guide 33 guides the pair of wheels 32 along the longitudinal housing direction 3. The actuators 14 are coupled to the holder 31 and thereby translate the holder 31 of the first rail 131. The protecting elements 152 of the rain gutter 15 further comprise a brush 50 which extends along the longitudinal housing direction 3. The brushes 50 are arranged such that each of the blade holders 222 lies onto the brush 50 when the shading blades 12 are in a closed position 6. The coupling elements 133 are for example rods. The first rail 131 extends along the longitudinal housing direction 3. In other words, the first rail 131 comprises a first longitudinal axis 47 along the longitudinal housing direction 3. The second rail 132 extends along the longitudinal housing direction 3. In other words, the second rail 132 comprises a second longitudinal axis 48 along the longitudinal housing direction 3.

Figure 8:
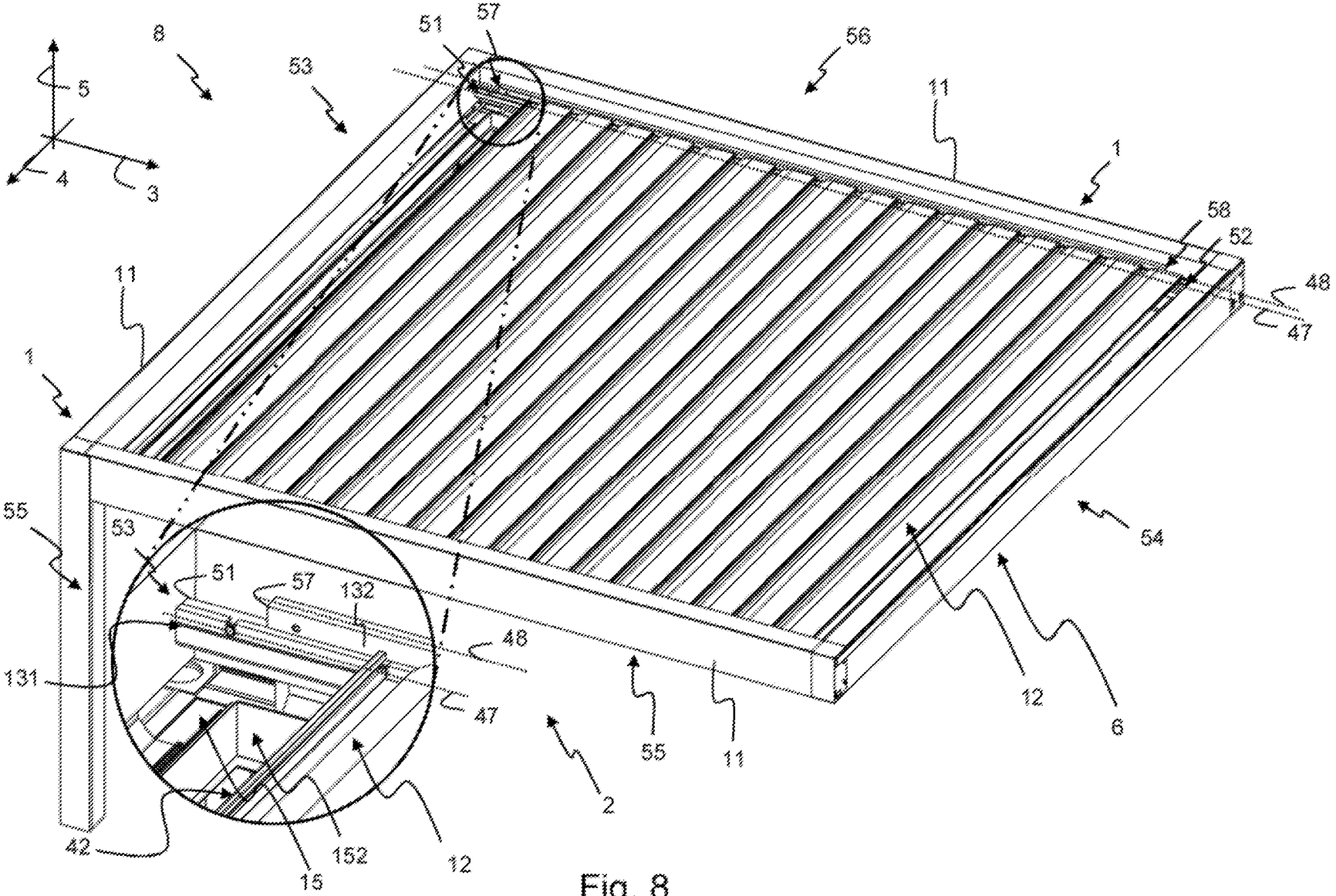
FIG. 8 schematically illustrates a side view of an embodiment of a shade assembly comprising at least one shading system according to the present invention.

According to an embodiment shown in FIG. 8, a shade assembly 8 comprises two shading systems 1 according to the present invention which share the same plurality of shading blades 12. The shading system 1 comprises a housing 11. The housing 11 is continuous and rectangular and the housing 11 comprises two pairs of opposite sides 53;54;55;56 such that the housing 11 of the pair of opposite sides 55;56 extends along a longitudinal housing direction 3 and such that the housing 11 of the other pair of opposite sides 53;54 extends along a longitudinal blade direction 4 traverse to the longitudinal housing direction 3. The shade assembly 8 further comprises two feet 55. Only one of these feet 55 is visible in FIG. 8 due to the perspective. The shade assembly 8 is for example mounted on a façade of a building on the side 54 of the housing 11, thereby covering an underlying space 2 close to the building. According to an alternative embodiment, the shade assembly 8 comprises one foot 55 and the housing 11 is mounted on a façade of a building for example on the sides 56 and 54 or on the sides 56 and 53 or on the sides 54 and 55 or on the sides 55 and 53. According to a further alternative embodiment, the shade assembly 8 comprises four feet 55 when for example the housing is not mounted on a façade of a building. According to further alternative embodiments, the shade assembly 8 comprises more than four feet 55. This increases the stability of the shade 8. The shade assembly 8 comprises a plurality of shading blades 12 arranged one after the other along the longitudinal housing direction 3, each of the shading blades 12 extending along the longitudinal blade direction 4. The shading blades 12 are movable between a closed position 6 and at least one open position. The shade assembly 8 further comprises a closing lip 42 arranged at the start of the plurality of shading blades 12 in the shading systems 1 along the longitudinal housing direction 3. Each shading system 1 comprises a coupling system between the housing 11 and the plurality of shading shades 12. As visible on the zoom on FIG. 8. each coupling system comprises a first rail 131 which comprises a first longitudinal axis 47 along the longitudinal housing direction 3. In other words, the first rail 131 extends along the longitudinal housing direction 3. The first rail 131 can translate along the longitudinal housing direction 3. As visible on the zoom on FIG. 8. each shading system 1 further comprises a second rail 132 which comprises a second longitudinal axis 48 along the longitudinal housing direction 3. In other words, the second rail 132 extends along the longitudinal housing direction 3. The second rail 132 can translate along the longitudinal housing direction 3 and can also translate along the longitudinal housing direction 3 with respect to the first rail 131. The first rail 131 comprises a first longitudinal axis 47 extending between the two edges 51 and 52 of the first rail 131. In other words, the first rail 131 extends for example five times, or ten times, or several hundred times more along the longitudinal housing direction 3 than along the longitudinal blade direction 4. The second rail 132 comprises a second longitudinal axis 48 extending between the two edges 57 and 58 of the second rail 132. In other words, the second rail 132 extends for example five times, or ten times, or several hundred times more along the longitudinal housing direction 3 than along the longitudinal blade direction 4. The second rail 132 is also shorter than the first rail 131 along the longitudinal housing direction 3, thereby allowing a relative movement of the second rail 132 with respect to the first rail 131 when the actuator translates the first rail 131 along the longitudinal housing direction 3. Each shading system 1 of the shade assembly 8 comprises a rain gutter 15 which extends along the longitudinal housing direction 3 and arranged below the plurality of shading blades 12. The rain gutter 15 comprises a protecting element 152. According to an alternative embodiment, the shade assembly 8 comprises a rain gutter 15 on all sides 53;54;55;56. Preferably, the shade assembly 8 for example measures 6 meters along the longitudinal housing direction 3, and measures 4 meters along the longitudinal blade direction 4 and is 2.5 meters high with respect to the ground on the underlying space 2 along the traverse direction 5. According to alternative embodiments, the shade 8 measures several meters along the longitudinal housing direction 3 and measures several meters along the longitudinal blade direction 4 and is several meters high along the traverse direction 5, wherein the length of the housing 11 of the shade assembly 8 along the longitudinal housing direction 3 is larger than the length of the housing 11 of the shade assembly 8 along the longitudinal blade direction 4. According to an alternative embodiment, the shade assembly 8 only comprises one shading system 1 which comprises a housing 11 and a plurality of shading blades and a coupling system between the housing 11 and the plurality of shading shades 12. For example, the shade assembly 8 comprises only one shading system 1 arranged at the side 56 of the shade assembly 8. According to an alternative embodiment, the shade assembly 8 comprises only one shading system 1 arranged at the side 55 of the shade 8. In this embodiment, the shade assembly 8 for example comprises a rain gutter 15 on all sides 53;54;55;56.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A shading system for covering an underlying space, said shading system comprising:

a housing extending along a longitudinal housing direction;

a plurality of shading blades arranged one after the other along said longitudinal housing direction, each of said shading blades extending along a longitudinal blade direction traverse to said longitudinal housing direction;

said shading blades being movable between a closed position thereby covering said underlying space, and at least one open position;

a coupling system arranged between said housing and said plurality of shading blades, wherein said coupling system comprises:

a first rail comprising a first longitudinal axis along said longitudinal housing direction configured to translate along said longitudinal housing direction;

a second rail comprising a second longitudinal axis along said longitudinal housing direction;

wherein each of said shading blades is rotatably coupled to said first rail at a first coupling point and rotatably coupled to said second rail at a second coupling point; and a coupling element rotatably coupled to said housing and rotatably coupled to said second rail;

an actuator configured to translate said first rail along said longitudinal housing direction;

wherein said coupling element limits a translation of said second rail along said longitudinal housing direction, thereby rotating said shading blades between said closed position and said at least one open position; and a rain gutter extending along said longitudinal housing direction and arranged below said plurality of shading blades.

2. The shading system according to claim 1, wherein said rain gutter comprises a rain gutter coupling element adapted to couple said rain gutter to said housing and a protecting element extending along said longitudinal housing direction;

wherein said protecting element is arranged traverse to said longitudinal blade direction such that shading blades partially overlap said rain gutter along said longitudinal blade direction.

3. The shading system according to claim 2, wherein each of said shading blades comprises:

a strip extending along said longitudinal blade direction, wherein said strip comprises said second coupling point; and a blade holder comprising:

a blade holder body configured to support said strip along said longitudinal blade direction;

a first blade holder tip comprising said first coupling point; and a second blade holder tip opposite said first blade holder tip.

4. The shading system according to claim 3, wherein when said shading blades are in said closed position, said shading blades are arranged partially superimposed, each over the next, with the second blade holder tip of a shading blade partially superimposing the first blade holder tip of the next shading blade along said longitudinal housing direction.

5. The shading system according to claim 3, wherein when said shading blades are in said open position, said shading blades are arranged each spaced from the next by an opening formed between the second blade holder tip of a shading blade and the first blade holder tip of the next shading blade along said longitudinal housing direction.

6. The shading system according to claim 1, wherein said shading blades rotate between said closed position and said at least one open position at said first coupling point around a first rotation axis extending along said longitudinal blade direction.

7. The shading system according to claim 1, wherein, when said coupling element limits said translation of said second rail along said longitudinal housing direction, said second rail moves along a traverse direction traverse to said longitudinal housing direction and to said longitudinal blade direction.

8. The shading system according to claim 3, wherein said first rail comprises:

a holder extending along said longitudinal housing direction and connected to each of said blade holders at each of said first coupling points;

wherein said holder comprises at least one pair of wheels configured to translate along said longitudinal housing direction; and a guide coupled to said holder and extending along said longitudinal housing direction;

wherein said guide is configured to guide said pair of wheels along said longitudinal housing direction; and wherein said actuator is coupled to said holder.

9. The shading system according to claim 3, wherein said protecting element of said rain gutter comprises a brush extending along said longitudinal housing direction;

wherein said brush is arranged such that each of said blade holders lies onto said brush in said closed position.

10. The shading system according to claim 1, wherein said coupling element is a rod.

11. A method for covering an underlying space, said method comprising the steps of:

providing a housing extending along a longitudinal housing direction;

providing a plurality of shading blades;

arranging said shading blades one after the other along said longitudinal housing direction, each of said shading blades extending along a longitudinal blade direction traverse to said longitudinal housing direction;

said shading blades being movable between a closed position thereby covering said underlying space, and at least one open position;

providing a coupling system arranged between said housing and said plurality of shading blades, wherein said providing a coupling system comprises:

providing a first rail comprising a first longitudinal axis along said longitudinal housing direction configured to translate along said longitudinal housing direction;

providing a second rail comprising a second longitudinal axis along said longitudinal housing direction;

wherein each of said shading blades is rotatably coupled to said first rail at a first coupling point and rotatably coupled to said second rail at a second coupling point; and providing a coupling element rotatably coupled to said housing and rotatably coupled to said second rail;

translating said first rail along said longitudinal housing direction;

wherein using said coupling element to limit a translation of said second rail along said longitudinal housing direction, thereby rotating said shading blades between said closed position and said at least one open position; and providing a rain gutter extending along said longitudinal housing direction and arranged below said plurality of shading blades.

* * * * *